US008413846B2

(12) United States Patent
Kasai

(10) Patent No.: US 8,413,846 B2
(45) Date of Patent: Apr. 9, 2013

(54) LIQUID SPOUTING NOZZLE, PACKAGING BAG USING THE NOZZLE, BOX FOR PACKAGING BAG AND PACKAGING STRUCTURE

(75) Inventor: Yoshikazu Kasai, Kanagawa (JP)

(73) Assignee: Yushin Co., Ltd., Niigata (JP)

( * ) Notice: Subject to any disclaimer, the term of this patent is extended or adjusted under 35 U.S.C. 154(b) by 108 days.

(21) Appl. No.: 12/914,747

(22) Filed: Oct. 28, 2010

(65) Prior Publication Data

US 2011/0042412 A1 Feb. 24, 2011

Related U.S. Application Data

(62) Division of application No. 11/572,731, filed as application No. PCT/JP2004/015765 on Oct. 19, 2004.

(30) Foreign Application Priority Data

Jul. 30, 2004 (JP) ..... 2004-224041

(51) Int. Cl.
*B65D 35/00* (2006.01)

(52) U.S. Cl. ..... 222/107; 222/494; 222/529; 222/572; 383/49; 383/906

(58) Field of Classification Search ..... 222/107, 222/527, 529, 572, 541.6, 491, 494; 383/906, 383/43, 49

See application file for complete search history.

(56) References Cited

U.S. PATENT DOCUMENTS 2,337,257 A 12/1943 Levingston
3,746,215 A 7/1973 Ausnit et al.
(Continued)

FOREIGN PATENT DOCUMENTS

GB 756346 9/1956
JP 4-53644 5/1992
(Continued)

OTHER PUBLICATIONS

Korea Office action, dated May 11, 2011 along with an English translation thereof.

(Continued)

*Primary Examiner* — Kevin P Shaver
*Assistant Examiner* — Daniel R Shearer
(74) *Attorney, Agent, or Firm* — Greenblum & Bernstein P.L.C.

(57) ABSTRACT

It is to provide a cheap liquid pouring nozzle having a one-way function for automatically closing an opening port at the same time of stopping the pouring of a packing material to surely prevent the penetration of air into a package bag, in which the detaching of a cap to the pouring nozzle is useless and the production is easy and the fusion-joining to a package bag main body is simple and sure, as well as a package bag using the same and a box for a package bag and a packaging structure. Such a nozzle is a liquid pouring nozzle constituted by fusion-joining its base end portion to an inner surface of a soft package bag main body at a side portion of the package bag main body through a sealant layer as an outermost layer, in which front and rear laminate films comprising a uniaxially oriented or biaxially oriented base film layer and sealant layers sandwiching it are fused to each other at a surrounding portion other than the base end at a posture of opposing one sealant layers to each other.

1 Claim, 16 Drawing Sheets

U.S. PATENT DOCUMENTS

| | | | | |
|---|---|---|---|---|
| 4,196,030 | A | 4/1980 | Ausnit | |
| 4,491,245 | A | 1/1985 | Jamison | |
| 4,686,125 | A * | 8/1987 | Johnston et al. | 383/116 |
| 4,830,205 | A | 5/1989 | Hammond et al. | |
| 4,833,008 | A | 5/1989 | Derby | |
| 4,878,600 | A | 11/1989 | Derby | |
| 5,108,195 | A | 4/1992 | Perron | |
| 5,244,281 | A | 9/1993 | Wiliamson et al. | |
| 5,863,131 | A | 1/1999 | Nakamura | |
| 5,996,845 | A | 12/1999 | Chan | |
| 6,062,467 | A | 5/2000 | Ours et al. | |
| 6,213,388 | B1 | 4/2001 | Ours et al. | |
| 6,386,760 | B1 | 5/2002 | Tomic | |
| 6,732,889 | B2 | 5/2004 | Oren et al. | |
| 6,776,307 | B1 * | 8/2004 | Hagihara | 222/107 |
| 2002/0141664 | A1 | 10/2002 | Matsuda et al. | |
| 2003/0022010 | A1 * | 1/2003 | Deeb et al. | 428/516 |
| 2003/0146247 | A1 | 8/2003 | Oren et al. | |

FOREIGN PATENT DOCUMENTS

| | | |
|---|---|---|
| JP | 6-156512 | 6/1994 |
| JP | 8-173298 | 7/1996 |
| JP | 8-282687 | 10/1996 |
| JP | 8-324585 | 12/1996 |
| JP | 9-112721 | 5/1997 |
| JP | 10-129681 | 5/1998 |
| JP | 11-222262 | 8/1999 |
| JP | 11-321885 | 11/1999 |
| JP | 2000-177755 | 6/2000 |
| JP | 2000-281091 | 10/2000 |
| JP | 2001-048198 | 2/2001 |
| JP | 2001-192068 | 7/2001 |
| JP | 2001-341755 | 12/2001 |
| JP | 2002-508283 | 3/2002 |
| JP | 2002-205763 | 7/2002 |
| JP | 2003-128143 | 5/2003 |
| JP | 2003-205949 | 7/2003 |
| JP | 2003-267446 | 9/2003 |
| JP | 2004-067102 | 3/2004 |
| JP | 2004-175439 | 6/2004 |
| JP | 2004-196364 | 7/2004 |
| JP | 2005-59958 | 3/2005 |

OTHER PUBLICATIONS

Search report from E.P.O., mail date is Jul. 8, 2011.
U.S. Appl. No. 12/593,477, filed Sep. 28, 2009.
U.S. Appl. No. 12/682,259, filed Apr. 9, 2010.

* cited by examiner

LIQUID SPOUTING NOZZLE, PACKAGING BAG USING THE NOZZLE, BOX FOR PACKAGING BAG AND PACKAGING STRUCTURE

CROSS-REFERENCE TO RELATED APPLICATIONS

The present application is a Divisional Application of pending U.S. patent application Ser. No. 11/572,731, filed on Jan. 26, 2007, which is a National Stage Application of International Application No. PCT PCT/JP2004/015765, filed Oct. 19, 2004, and claims priority under 35 U.S.C. §119 of Japan Application No. 2004-224041, filed Jul. 30, 2004, the disclosure of each of which is expressly incorporated herein by reference in its entirety.

TECHNICAL FIELD

This invention relates to a liquid pouring nozzle made from a laminated film and formed by integrally uniting with a side or a top of a package bag main body being soft and having an excellent flexibility or by separating from the package bag main body and fusion-joining thereto in the production of the package bag or in the filling of a liquid packing material as well as a package bag applied thereto and a box for the package bag and a packaging structure.

Particularly, the invention proposes a liquid pouring nozzle which is cheap, easy in the production and handling and is provided with a so-called one-way function capable of sufficiently preventing the entrance of air into the inside of the package bag after the opening in the plural pourings of the packing material and a package bag using the same as well as a box for the package bag giving a constant shape formability to the package bag and facilitating the pouring operation of the packing material from the liquid pouring nozzle over plural times and simply and surely housing the liquid pouring nozzle after the pouring into the box and a packaging structure using the same.

BACKGROUND ART

For example, as a package bag for food and drink, flavoring and others of liquid, jelly or the like having a volume of more than 100 ml, there is a bag formed by thermal-fusing a capped pouring nozzle made of an injection molded plastic onto an inner face of a relatively hard package bag main body including an aluminum foil. In this case, the packing material can be poured over plural times by the detaching and screwing operation of the cap with respect to the pouring nozzle.

In this package bag, however, the cost of the pouring nozzle and cap as a plastic shaped product becomes high, and there is the burden of the handling that the complete thermal fusion of the pouring nozzle having a three-dimensional stereo form onto the package bag main body under a sufficient joining strength is difficult even by using a special heat-seal means or the like but also it is required to conduct the detaching and rescrewing of the cap every the pouring of the packing material. Furthermore, as to the package bag being relatively hard and hardly causing the crush deformation, it is necessary to replace the packing material with ambient air in the package bag and also the invasion of ambient air into the interior of the package bag is unavoidable up to the screwing of the cap to the pouring nozzle after the completion of the pouring, so that there is a problem that the packing material is contaminated by dust, virus and the like in the ambient air, or the ambient air itself oxidizes the packing material to damage the taste or the like of the flavoring and alcohol drink.

The invention is the subject matter to solve the above problems of the conventional techniques. A first object of the invention is to provide a cheap liquid pouring nozzle having a self-seal one-way function adapting to a soft package bag main body based on shrink or collapse deformation when the pouring of a packing material from a package bag is carried out without entrapping air into the package bag and automatically closing the pouring port with the wetting of the packing material at the same time of stopping the pouring the packing material to surely prevent the invasion of air into the package bag, which can be produced simply without requiring the detaching operation of a cap to the pouring nozzle and can always conduct surely and easily the integral uniting with the package bag main body or the pose fusion joining thereto, as well as a package bag using the same.

As a box-shaped vessel used for pouring the liquid packing material filled therein plural times are generally and widely used various paper cartons such as milk package, fruit juice package and the like.

The paper carton is used as a package vessel for the packing material having a volume of, for example, about 100-3000 ml, and is easy in the handling as compared with a glass bottle, a plastic bottle, a can and the like, and has a merit that the floor area efficiency is higher than those of various bottles, cans and the like having an outer profile form of a circle in the display at stores.

However, this type of the paper carton itself is assembled by fusion-joining a resin material and the packing material is directly filled in an inside thereof, and further it is required to provide a sufficient resistance to wettability, so that a resin material such as polyethylene or the like is laminated at least onto both surfaces, and hence it is unavoidable to remove the resin material in the recycling of the paper carton. On the other hand, in the production of the paper carton itself, it is necessary to use 100% virgin pulp and there is a problem that waste paper can not be used.

Further, in the opening of the paper carton having a roof form in its top, there are problems that it is required to peel off the fusion-joined portion of the resin material in the roof-shaped top through fingers but also it is frequently impossible to conduct the adequate opening and further it is impossible to sufficiently close the opened portion.

On the contrary, the paper carton of a brick type having a flat top has still a trouble in the opening that the fused end portion folded toward the side wall is cut by scissors, but the opening as is expected is surely conducted by such a cutting and also it is possible to close the opened portion by folding the fusion-joined portion toward the side wall.

In the paper carton of the brick type, however, there is a problem that a fear of flowing down the packing material in an unintended direction is high in the first pouring because the filling height of the packing material becomes frequently close to the opening height.

It is, therefore, the second object of the invention to solve the above problems of the conventional paper cartons and to provide a box for a package bag wherein a packaging structural body is functionally separated into a soft package bag developing a filling and packaging function and a box for package bag giving a fixed formability thereto to omit a laminate of a resin material to the box body and make the use of waste paper possible and further the trouble of the opening in the box body is removed to simply and surely conduct the opening as is expected and also the closing of the opened portion is sufficiently ensured and further the flowing direction of the packing material is easily specified, as well as a packaging structural body using the same.

DISCLOSURE OF THE INVENTION

The liquid pouring nozzle having a one-way function according to the invention is formed by fusion-joining base end portions of a soft package bag main body at its a side portion or a top portion in an inner surface of the package bag main body through an outermost sealant layer, in which front and rear side laminate films each comprising a thermoplastic, uniaxially or biaxially oriented base film layer inclusive of a proper vapor-deposition layer and/or a metal foil layer such as aluminum and sealant layers sandwiching the base film layer, for example, two front and rear laminate films or one laminate film folded at a central portion thereof forward and rearward are fused with each other at surrounding portions other than a neighborhood of a base end at a posture of opposing to one sealant layer.

Such a liquid pouring nozzle can be produced simply and rapidly by fusion-bonding the sealant layer, which may be made from a non-oriented polyethylene layer (hereinafter referred to as PE layer) or polypropylene layer (hereinafter referred to as PP layer), in the respective front and rear laminate films at a required portion of the laminate film through, for example, a heat sealing, a high frequency sealing, an impulse sealing or the like.

At this moment, when the fusion-joined portion is formed by heat-sealing the sealant layers opposing thereto, there can be surely, simply and rapidly formed the fusion-joined portion having the predetermined width and the like at a relatively low temperature.

In the liquid pouring nozzle made of the laminate film having at least three-layer structure of the above construction and a liquid pouring nozzle made of a laminate film having at least two-layer structure as mentioned later, it is preferable that the orienting direction of the uniaxially oriented base film layer or the longitudinal direction (MD) of the biaxially oriented base film layer is arranged substantially in a widthwise direction of the laminate film or a required proceeding direction of tear in order to easily conduct the required tearing opening through fingers.

The term "substantially the widthwise direction of the laminate film" used herein means that in either of the package bag formed by fusion-joining the liquid pouring nozzle to the package bag main body or the package bag formed by integrally uniting the nozzle with the package bag main body, the widthwise direction of the laminate film is usually in the direction corresponding to the up and down directions of the package bag, but it is considered that the proceeding direction of the tear opening of the nozzle or the extending direction of the edge of the pouring port of the nozzle is intentionally inclined at an angle of 0-15° with respect to the widthwise direction of the laminate film in such a direction that the lower end portion of the pouring edge separates away from the package bag main body.

Also, the base film layer used herein is uniaxially or biaxially oriented polyethylene terephthalate, ethylene-vinyl alcohol copolymer, nylon, polypropylene and the like and may be formed by providing a required vapor deposited layer thereon. Among them, when the base film layer is a biaxially oriented polyethylene terephthalate film layer, it is preferable to use a straight-cutting polyester film such as Emblet PC (registered trade mark, made by Unitika Co., Ltd.), while when the base film layer is a biaxially oriented nylon film layer, it is preferable to use a straight cutting nylon film such as Emblem NC (registered trade mark, made by Unitika Co., Ltd.). That is, these films can give a high steam impermeability, a gas burlier property and the like to the pouring nozzle as compared with the case of using the uniaxially oriented base film layer but also can smoothly and easily conduct the straight tearing of the top end portion of the pouring nozzle through fingers and can sufficiently smooth the tearing flaw with napless to more sufficiently develop the close sealing function of the pouring nozzle.

In the pouring nozzle made of the laminate film of at least three-layer structure as mentioned above, the sealant layer located at the outer surface of the nozzle, e.g. non-oriented various PE layers, PP layer, polyolefinic resin layer such as polyethylene layer made with a metallocence catalyst or the like, ethylene-vinyl acetate copolymer layer, ethylene-ethyl acrylate copolymer layer, ionomer layer or the like is fused onto a sealant layer of, preferably the same kind as an inner surface layer of a soft package bag main body through, for example, heat sealing, whereby the base end portion of the pouring nozzle can be fusion-joined simply, rapidly, and always surely to the package bag main body. In this way, there can be produced the package bag comprising the package bag main body and the pouring nozzle projecting outward from the side portion or the top portion of the package bag main body.

In this case, the sealant layer located a the inner surface of the nozzle may be naturally formed by the same material as mentioned above.

When the outer surface of the base end portion of the pouring nozzle made of the laminate film of at least three-layer structure provided on its inner and outer surfaces with the sealant layers is fusion-joined with the inner surface of the package bag main body as mentioned above, in order to surely prevent the inner surfaces of the pouring nozzle from adhering to each other, it is effective that a release sheet having a higher melting point or not causing heat fusion is arranged at an inside of the base end portion of the nozzle, or that the fusion temperatures of the sealant layers located at the inner and outer surfaces of the nozzle are made different from each other by changing the materials or extrusion laminating conditions of the sealant layers made of the same material to make the melting point of the sealant layer located at the inner surface of the nozzle higher than that of the sealant layer located at the outer surface of the nozzle, or the like.

The filling and packing of the liquid packing material such as seasoning, soup or others to the package bag can be carried out simultaneously when the liquid pouring nozzle made of the laminate film of at least three-layer structure is joined to the package bag main body, or after the joining. The filling and packing is preferable to be carried out at a state of sufficiently removing air form the inside of the package bag, for example, by filling in liquid or by ventilating air from the bag after the filling of the packing material in view of preventing the oxidation of the packing material inside the bag and the like, and also in view of surely developing the one-way function in the pouring nozzle as mentioned later.

This is true in the case that the liquid pouring nozzle of a laminate film of at least two-layer structure is integrally united with the package bag as mentioned later.

The pouring of the packing material in the bag for the use, consumption or the like can be carried out by removing the top fused portion of the pouring nozzle through tear cutting with fingers or the like irrespectively of the films of two-layer structure, three-layer structure and the like to form a top pouring port in the nozzle and then tilting the package bag so as to take a posture of directing the pouring port of the nozzle downward. In this case, the pouring nozzle made of the soft laminate film allows the pouring of the packing material, if necessary, by separating the front and rear sides from each other under an action of a water head pressure of the packing material to open the top pouring port by only a required amount.

When the packing material is poured, the soft package bag main body renders into a shrinking or collapsing deformation by the amount corresponding to the pouring volume accompanied with the pouring of the packing material without sucking air.

After the required amount of the packing material is poured by the tilting of the package bag, the pouring is stopped by returning the package material to an original stand posture, and the inner surfaces of the nozzle wetted with the packing material are closely adhered to each other under the presence of the thin film of the packing material based on the stop of the pouring over a whole of the front and rear films of the pouring nozzle in the widthwise direction or up-down direction to close the top pouring port of the nozzle and surely prevent the penetration of air into the interior of the package bag.

In the package bag provided with such a pouring nozzle, therefore, the packing material inside the bag is sufficiently protected from the contact with air before the pouring but also during the pouring and after the pouring, whereby the oxidation, contamination and the like of the packing material inside the bag are prevented effectively.

Such a closing of the front and rear films in the pouring nozzle is automatically carried out by returning the package bag to a stand state and releasing the pouring nozzle from the action of the water head pressure to return to an original form at the production but also by flowing back the packing material in the pouring nozzle into the interior of the package bag main body to expose inner faces in the front and rear films wetted with the packing material to an atmosphere under a reduced pressure and adsorb with each other so that the wet state is maintained by a capillary action. This closing becomes more sure when the package bag main body shrunk or collapse-deformed accompanied with the pouring of the packing material from the package bag tends to reduce the pressure in the inside thereof based on the elastic restoring force inherent to the main body.

Thus, the top pouring port can be automatically close-sealed together with the stand returning of the package bag without conducting the special operation to the pouring nozzle and the excellent one-way function can be developed in the pouring nozzle.

Further, the close-sealed state is generated over substantially the whole of the inner surface of the nozzle, so that the one-way function is surely developed even if a solid matter may be incorporated as a foreign matter into the nozzle.

On the other hand, the re-pouring of the packing material can be conducted by tilting the package bag as mentioned above, while the stop thereof can be conducted in the same manner as mentioned above. Even in this case, the pouring nozzle develops an excellent one-way function to the penetration of air based on the automatic close-sealing.

In order to tear-remove the top fuse-joined portion of the pouring nozzle with fingers for functioning the pouring nozzle as mentioned above, it is preferable to form a V-shaped fold portion located in correspondence with the opening position of the nozzle in at least one of the fused portions in the widthwise direction of the laminate film of three-layer or more structure or two-layer or more structure. In this case, the fused portion itself is folded into the V-shaped form, so that the tearing can be sufficiently introduced into the fused portion without separately forming the tear-introducing flaw such as V-notch, -notch or the like, and also the visual observation of the tear-introducing place can be easily facilitated.

In such a pouring nozzle, the fused portions of the laminate film of at least three-layer structure or two-layer structure opposite to the widthwise direction are extended slantly from the V-shaped fold portion in the down direction at the base end portion side rather than the position of forming the above V-shaped folded portion even if there is somewhat a bending, retaining or the like. Preferably, the gap between the fused portions of the laminate film opposite to the widthwise direction is gradually decreased between the base end portions and the position of forming the V-shaped folded portion toward the V-shaped folded portion even if an equal gap portion or the like is existent partly.

According to the former case, when a great amount of the packing material is particularly existent in the package bag main body, a fear of accidentally flowing out the packing material from the pouring nozzle can be removed advantageously. According to the latter case, the control of the pouring amount and the pouring direction in the pouring of the packing material from the top pouring port of the pouring nozzle can be made easily.

In the package bag according to an embodiment of the invention, the base end portion of the liquid pouring nozzle made of the laminate film of three-layer or more structure is fusion-joined to the inner face of the package bag main body at the fused portion between the sealant layers in the soft package bag main body, whereby the liquid pouring nozzle is projected from the side portion or top portion of the package bag main body.

In this case, as the film construction of the soft package bag main body, the base film layer located at the outer surface and the sealant layer located at the inner surface may be the same kind of the base film layer and sealant layer in the pouring nozzle, respectively, and also a middle layer may be properly interposed therebetween.

In this embodiment of the package bag, it is preferable that the sealant layer forming the inner surface of the soft package bag main body is made from the same resin material as the sealant layer of the outer surface of the liquid pouring nozzle. Thus, the fusion joining strength of the liquid pouring nozzle to the package bag main body can be enhanced sufficiently.

The respective sealant layers in each of the liquid pouring nozzle made of the laminate film of three-layer or more structure and the package bag main body fused thereto as well as the pouring nozzle made of the laminate film of two-layer or more structure mentioned later or the package bag main body may be laminated with an extrusion laminate or dry laminate to the base film layer.

The another liquid pouring nozzle made of a laminate film of at least two-layer structure is integrally constituted so as to project from the side portion of top portion of the soft package bag main body and usually made of the same film as the package bag main body in which two or folded type laminate film made of a uniaxially or biaxially oriented base film layer and a sealant layer laminated at its surface side is fused with each other at a posture of opposing the sealant layers to each other in the vicinity of the projected portion from package bag main body previously formed or ex-post or simultaneously formed, preferably through heat sealing.

This pouring nozzle is surely produced simply, rapidly and cheaply and as is expected at the same time of or before or after the formation of the package bag main body and can be always integrally constituted with the package bag main body properly. Also, in the pouring of the packing material from the package bag or the stop thereof, the penetration of air into the inside of the package bag can be effectively prevented by functioning likewise the previous liquid pouring nozzle made of the films of at least three-layer structure.

In any of these liquid pouring nozzles, the uniaxially or biaxially oriented base film layer of the laminate film is preferable to be constituted with polyethylene terephthalate film layer (hereinafter referred to as PET layer) or nylon resin film layer (hereinafter referred to as NY layer) having a thickness of 8-30 μm and the presence or absence of a deposited layer. The sealant layer of the laminate film is preferable to be constituted with a non-oriented PE layer or PP layer having a thickness of 10-60 μm.

That is, the PET layer and NY layer as the base film layer are preferable in view that the excellent steam impermeability and high gas burlier property are developed in the pouring nozzle. Also, the PE layer and PP layer as the sealant layer are preferable in view that the excellent seal strength is developed at a relatively low heat sealing temperature.

When the thickness of the base film layer is less than 8 μm, there is a fear that the steam impermeability and gas burrier property are lacking, while when it exceeds 30 μm, the bending strength of the laminate film is too large and there is a fear that the adhesion property at the inner surface of the nozzle is damaged after the stop of the pouring of the packing material.

Also, when the thickness of the sealant layer is less than 10 μm, the sufficient seal strength can not be ensured, while when it exceeds 60 μm, there is a fear of increasing too the bending strength of the laminate film.

Moreover, the steam permeability of the uniaxially or biaxially oriented base film layer is preferable to be not more than 10 g/($m^2$□24 h) at a temperature of 40° C. and a humidity of 90% even in any liquid pouring nozzles.

When the steam permeability exceeds 10 g/($m^2$□24 h), there are a fear that a closed state of the liquid pouring nozzle maintained under the presence of a thin film of the packing material is released in a short period of not more than 10 days because the thin film existing in the pouring nozzle is lost in a relatively premature stage and a fear that a crystal precipitated after the losing of a liquid content such as water or the like bring about the blocking in the inner surface of the nozzle.

The bending strength of the laminate film per a width of 15 mm, or a nerve is preferable to be 40-300 mN as measured by the following method.

When the nerve is less than 40 mN, it is difficult to precisely specify the pouring direction or the like in the pouring of the packing material from the package bag, and the nerve feeling of the package bag main body in the liquid pouring nozzle made of the laminate film of two-layer or more structure integrally united with the package bag main body is weak and there is a fear of developing the poor strength of the package bag itself.

While when it exceeds 300 mN, there is a fear of lowering the close sealing function of the pouring nozzle irrespectively of the lamination structure of the laminate film.

Also, the extended length of the pouring port edge of the nozzle extending substantially in the widthwise direction of the laminate film is preferable to be 5-40 mm irrespectively of the lamination number of the laminate film.

The term "substantially in the widthwise direction" used herein considers a point that the tearing direction and hence the extending direction of the pouring port edge of the nozzle is inclined at an angle of 0-15° with respect to the widthwise direction of the laminate film.

When the length of the pouring port edge of the nozzle is less than 5 mm, the pouring amount is too small in relation with the volume of the package bag main body, while when it exceeds 40 mm, it is difficult to accurately specify the pouring direction and also the fear of accidentally penetrating air onto the pouring nozzle becomes high.

The package bag using the another pouring nozzle made of the laminate film of two-layer or more lamination structure is constituted by integrally uniting the same pouring nozzle as previously mentioned with the package bag main body at the same time of forming the package bag or after the formation thereof from the side portion or top portion of the soft package bag main body.

Moreover, the former includes a case that the package bag main body is formed after the production of the pouring nozzle in addition to the case that the liquid pouring nozzle is produced at the same time of forming the package bag main body.

In this package bag, the laminate film for the package bag main body and the laminate film for the liquid pouring nozzle are common, so that the step of fusion-joining both is useless and also the production of independent pouring nozzle may be useless and hence the occurrence of joining defective or the like can be removed completely and the required package bag can be produced more simply, rapidly and cheaply.

In the pouring of the packing material from such a package bag, the liquid pouring nozzle can be acted likewise the preciously mentioned first package bag, and after the stop of the pouring of the packing material, the close sealing of the pouring nozzle can be maintained under the presence of the thin film of the packing material over a long time of period to effectively prevent the penetration of air into the package bag.

In the package bag mentioned above, when the outer surface of the portion forming at least a pouring port of the liquid pouring nozzle or the outer surface in the vicinity of the pouring port is coated with a volatile substance such as silicone oil, waxy substance or the like irrespectively of the lamination structure of the laminate film, or when ultra-fine unevenness such as lotus leaf, aroid leaf or the like is given to the outer surface, the package bag is returned to a stand posture to enhance a so-called liquid cutting property in the stop of the pouring of the packing material, whereby the accidental fall-down of the packing material can be prevented effectively.

Further, when the above package bags are used, at a state of forming the pouring port by tearing or cutting the top end portion of the liquid pouring nozzle in the package bag, the packing material in the package bag is poured from the pouring port formed in the liquid pouring nozzle at a posture of tilting the package bag housed in a box body made of a paper or the like without sucking air, while in the stop of the pouring based on the stand returning of the package bag, the inner surfaces of the liquid pouring nozzle are closely adhered to each other over a whole thereof in the presence of the thin film of the packing material wetting the inner surfaces to prevent the penetration of air into the package bag.

In such a use, the pouring of the packing material is carried out under a shrinkage or collapse deformation of the package bag main body without sucking air into the package bag, while after the stop of the pouring, the penetration of air into the package bag can be prevented by adhesion sealing of the inner surfaces of the pouring nozzle irrespectively of the sandwiching of the solid matter in the pouring nozzle, whereby the contamination, oxidation and the like of the packing material retaining in the package bag due to air can be prevented sufficiently.

As seen from the above, according to the invention, the liquid pouring nozzle made of a laminate film of two or folded structure being two-layer or three-layer lamination structure can be produced very cheaply, and the integral constitution of the pouring nozzle with the package bag main body or the joining thereto can be always surely conducted simply by common heat sealing or the like.

Also, the pouring of the packing material in the bag can be simply conducted only by the tilting and standing-up operation of the package bag itself without the special operation or the like to the nozzle except for the initial pouring by tearing the top end portion of the nozzle or the like.

Furthermore, the packing material in the bag can be protected effectively to the oxidation, contamination, deterioration of flavor and the like by preventing the penetration of air into the package bag through collapse deformation of the package bag main body, development of the excellent one-way function of the pouring nozzle and the like.

In addition, the box for the package bag according to the invention comprises a door member fitting into an opening formed at an upper part of a side wall of a box body made of a paper so as to swingably displace on a horizontal plane using an angle of the side wall as a supporting point, and a protrusion arranged in the side wall and engaging with the outer surface of the door member.

The position of forming the protrusion to the door member may be a position corresponding to a straight extended portion of the door member extending in up-down direction, horizontal direction or a slant direction, or may be a position corresponding to such a corner part that an outer profile of the door member is a going or coming angle. In the latter case, the accidental opening of the door member can be effectively prevented by the sufficiently small one protrusion.

Preferably, a stopper is disposed on the door member so as to engage with the inner surface of the side wall for restraining the excess opening of the door member. Moreover, the stopper is advantageous to be connected to an upper end of the door member through a connecting member in view of materials in the box for package and assembling step number of the box.

On this case, the connecting member is preferable to be an open-close guide formed in form of a fan about a swing supporting point of the door member over an angle range of 90° and sliding along a boundary part between the side wall and a cap or a top folded part connecting thereto in view of the guarantee of smoothly and surely open-close operation of the door member.

Preferably, a plurality of convexes or concaves extending in a horizontal direction are arranged in at least a lower half portion of the box body over a full width or at least a part of the side wall. Thus, the deformation strength of the box body can be enhanced, and when the soft package bag filled with the packing material is housed in the box body, the expansion deformation of the box body can be advantageously prevented under the use of a thin paper material to more effectively enhance the shape formability.

When the box body is made of a water-proof paper, the shape formability can be ensured more sufficiently without laminating a resin material to the box body as to a somewhat wetting such as dew drop or the like.

The packaging structure according to the invention is one used in the box for the any one of the above package bags, in which package bag formed by fusion-joining the flat liquid pouring nozzle sealed at its top end to the upper end portion of the soft package bag main body at a posture of projecting toward the side is housed in the boxy for the package bag and the liquid pouring nozzle is attached to the inner face side of the door member and a part of the liquid pouring nozzle is located at a position corresponding to the swing supporting point of the door member.

In order to develop the function inherent top the packaging structure, a liquid packing material is filled in the package bag. In this case, it is preferable that the upper part of the package bag is fixed or adhered to the upper part, top part or the like of the box body at plural places for preventing the lowering of the package bag to the bottom of the box body.

Also, it is preferable to attach the liquid pouring nozzle to the door member at a posture of separating at least top end portion thereof from the inner surface of the door member. Thus, when the top end port is formed in the liquid pouring nozzle to pour the liquid packing material therefrom, the inner surface of the door member can be prevented from wetting with the packing material, and also the packing material adhered to the door member can be prevented from flowing down to the inside of the box body in the stop of the pouring based on the standing-up operation of the box body.

The liquid pouring nozzle can be attached to the door member by locally fixing or adhering to the inner surface side of the door member directly or through a spacer, or may be attached by holding at the inner surface side of the door member. The holding of the liquid pouring nozzle can be carried out by integrally forming with the door member to fold-fix or adhere the folded portion restraining the liquid pouring nozzle.

Of course, the folded portion may be integrally formed with the door member. Alternatively, the folded portion may be disposed to a spacer member integrally or separately formed with the door member for separating the top end portion of the liquid pouring nozzle from the inner surface of the door member.

In the box for the package bag according to the invention, the door member is swingably displaced on the upper part of the side wall in the box of paper, whereby the door member can be displaced to open and close between an opening position separating from an opening of the upper part of the side wall and a closing position just fitting into the opening of the side wall. In the closing position of the door member, an engaging protrusion is engaged with the outer surface of the door member by the elastic deformation of at least one of the door member and the engaging protrusion of the side wall based on the pushing toward the inside direction of the box body, whereby the door member can be surely restrained at the closing position.

On the other hand, the opening of the door member can be carried out push-deforming the neighborhood portion in the engaging protrusion of the side wall with fingers to enter the protrusion into the inside of the door member through the elastic deformation of at least one of the protrusion and the door member and then releasing the door member with the fingers.

Thus, the opening of the door member and hence the opening of the box body can be conducted simply as is always expected without using a tool, and the closing of the opening port accompanied with the closing of the door member can be conducted surely.

The box for the package bag gives the shape formability to the soft package bag filled with the packing material and acts to assist the tilting pouring operation. Since the packing material is not directly filled into the box, it is useless to dispose the laminate layer of the resin material when the box body itself is made form a water-proof paper, and also a water paper can be applied to the box body.

In the box for the package bag, the liquid pouring nozzle of the package bag is attached to the inner surface side of the door member, so that the flowing direction of the packing material from the opening port formed in the nozzle can be always and easily specified and the packing material can be surely flowed down to an expected position.

This is more effective when the stopper specifying the opening limit position of the door member is disposed to specify the opening position of the door member to the opening limit position in the pouring of the packing material.

When a plurality of concaves extending the horizontal direction are disposed in at least a lower half portion of the box body, even if the thickness of the paper constituting the box body is made thin, the deformation strength of the package bag to be housed in the box for the package bag filled with the packing material can be enhanced to bring about the excellent shape formability. As a result, the sufficient shape formability can be developed, for example, by using a paper of 270-350 (g/cm$^2$) to the 1000 ml of the packing material.

In the packaging structure according to the invention, the top end portion of the liquid pouring nozzle attached to the inner surface side of the door member is removed by tearing with, for example, fingers under the opening of the door member to form an opening port in the pouring nozzle, whereby the packing material filled in the package bag can be properly poured and stopped through the opening port based on the tilting operation of the box for the package bag.

When the package bag is tilted together with the box for the package bag so as to take a posture of directing downward the opening port of the nozzle, the pouring nozzle made of the soft laminate film is separated to front and rear sides under the action of the water head pressure of the packing material to release the top end opening port to allow the pouring of the packing material, if necessary.

In the pouring of the packing material, the soft package bag main body is shrink or collapse deformed by the amount corresponding to the pouring volume without sucking air accompanied with the pouring of the packing material.

After the required amount of the packing material is poured, the package bag is returned to the original stand posture together with the box to stop the pouring and at the same time of stopping the pouring, the front and rear films of the pouring nozzle are adhered to each other in the widthwise direction or up-down directions thereof to surely prevent the penetration of air into the package bag.

In the package bag provided with the pouring nozzle, therefore, the packing material in the bag is sufficiently protected from contacting with air before, during and after the pouring of the packing material, and hence the oxidation, contamination and the like of the packing material in the bag are prevented sufficiently.

The adhesion between the front and rear films in the pouring nozzle is automatically conducted over substantially the whole of the pouring nozzle by releasing the pouring nozzle from the action of water head pressure to return to the original form in the production through the standup returning of the package bag and by exposing the front and rear films to an atmosphere under a reduced pressure to adsorb to each other under a negative pressure in the flowing of the packing material in the pouring nozzle to the package bag main body. Such an adhesion is assisted by rendering the inside of the package bag main body shrink or collapse deformed accompanied with the pouring of the packing material from the package bag into a reduced pressure based on the elastic returning force inherent thereto.

At this moment, the top end opening port of the pouring nozzle can be automatically closed and sealed together with the stand returning of the package bag without the special operation to the nozzle, whereby the excellent one-way function can be developed in the pouring nozzle.

After the required pouring of the packing material, the door member in the box for the package bag is rendered into the closing position of fitting into the opening port of the side wall to cause the engagement of the protrusion in the side wall with the outer surface of the door member and hold the door member at the closed posture.

Under such a closed posture of the door member, the liquid pouring nozzle partly located at a position corresponding to the swing supporting point of the door member is folded substantially in, for example, the vertical direction to more surely adhere the front and rear films of the pouring nozzle with each other, so that the penetration of air into the package bag is more sufficiently prevented at the closed state of the door member. Also, even if the box for the package bag is improperly fallen down, the accident leakage of the packing material can be prevented effectively.

On the contrary, the re-pouring of the packing material can be carried out by releasing the engagement of the door member in the box with the engaging protrusion and tilting the package bag together with the box as previously mentioned. In this case, the pouring nozzle develops the excellent one-way function to the penetration of air based on the automatic closing sealing.

Moreover, the attachment of the liquid pouring nozzle to the inner surface side of the door member is conducted by local fixation or adhesion, whereby the sufficient separate displacement between the front and rear films of the nozzle can be conducted smoothly. In other words, when either of both the films in the nozzle is mechanically fixed or adhered with an adhesive or the like over the full width thereof, there can not be guaranteed the sufficiently large separate deformation between the front and rear films of the pouring nozzle.

This is also true when the pouring nozzle is held by fold fixation or adhesion of the folded portion integrally united with the door member. When the pouring nozzle is strongly sandwiched by the folded portion, the front and rear films in the nozzle can not be sufficiently separated in the pouring of the packing material.

When the pouring nozzle is held by the folded portion or the like, there is a merit that the bending deformation of the liquid pouring nozzle as mentioned above can be surely conducted by the folded portion accompanied with the closing operation of the door member.

BEST MODE FOR CARRYING OUT THE INVENTION

Figure 1:
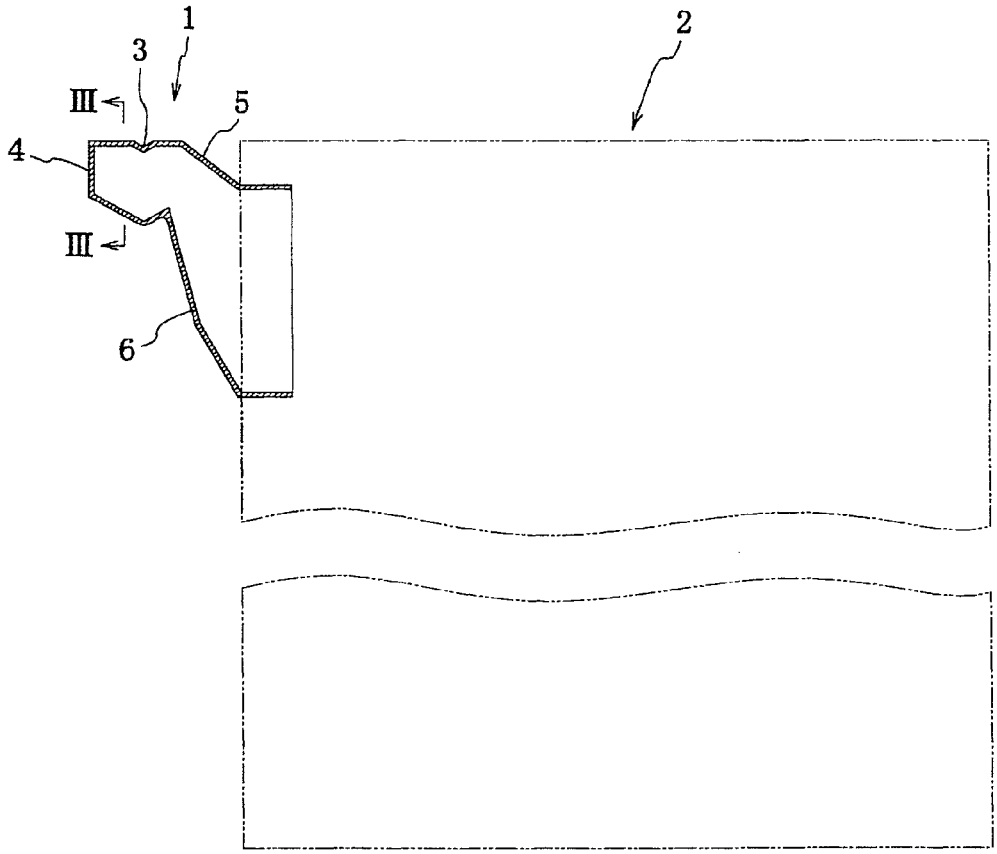
FIG. 1 is a plan view showing an embodiment of the liquid pouring nozzle according to the invention.

In FIG. 1 showing an embodiment of the liquid pouring nozzle according to the invention, a liquid pouring nozzle 1 is fusion-joined at its base end portion to a fused side portion of a soft package bag main body 2 through a sealant layer made of the same resin material as a sealant layer on an inner surface of the package bag main body, preferably an outermost sealant layer.

The liquid pouring nozzle 1 is a laminate film comprising a thermoplastic base film layer, for example, a uniaxially or biaxially oriented PET layer or NY layer having a thickness of 5-40 μm, preferably 8-30 μm and provided with a required deposit layer, and sealant layers laminated on both surfaces of the base film, for example, non-oriented PE layers or PP layers having a thickness of 5-80 μm, preferably 10-60 μm That is, it can be constituted by mutually fusion-joining two front and rear laminate films having the same profile form or one laminate film folded at its central portion at each portions other than the base ends at a posture of opposing the sealant layer at an inner surface side, preferably through heat sealing as shown by diagonal lines in the figure.

In the figure, numeral 3 is a V-shaped fold portion formed at a tear planning position of the pouring nozzle 1 on one fused portion opposing to the widthwise direction of the nozzle, usually up-down directions in the figure instead of a tear start flaw. The V-shaped fold portion 3 acts to facilitate the tear removal of the nozzle top end of the pouring nozzle 1 inclusive of a top end fused portion 4. In this case, the V-shaped fold portion 3 may be formed in the lower side fused portion in the figure instead of the above or in further addition.

It is preferable that each of two up and down fused portions 5, 6 located opposite to the widthwise direction of the nozzle and extending up to the base end of the pouring nozzle 1 is extended at a side of the base end portion than the forming position of the V-shaped fold portion 3 downward slantly from the V-shaped fold portion 3. Also, it is preferable that the interval between the fused portions 5, 6 is gradually decreased between the base end portion and the forming position of the V-shaped fold portion 3 toward the V-shaped fold portion 3.

Figure 2:
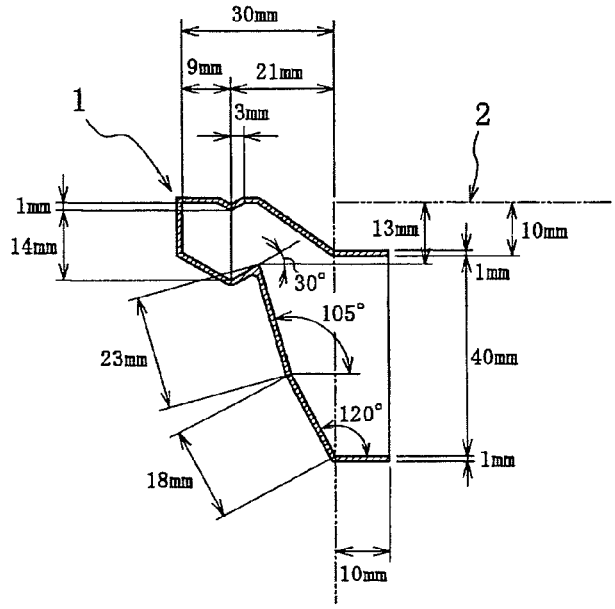
FIG. 2 is a schematic view showing a concrete example of the pouring nozzle.

Concretely, as shown, for example, in FIG. 2, an inner width of the base end of the nozzle 1 may be 40 mm, and a length from the base end to the forming position of the V-shaped fold portion 3 may be 31 mm, and an inner width at the forming position of the V-shaped fold portion 3 may be 14 mm. In such a pouring nozzle, a base end portion having a width of about 10 mm at the side of the base end is a fusion joining part for the package bag main body 2.

Figure 3:
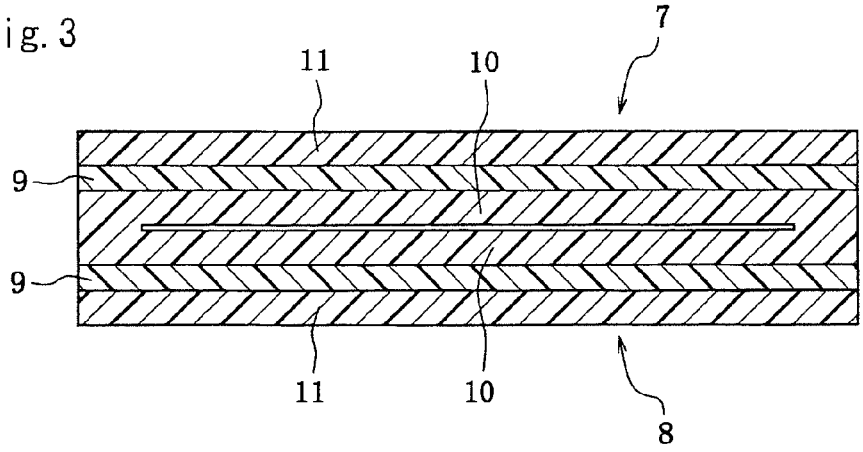
FIG. 3 is an enlarged section view taken along a line of FIG. 1.

As the pouring nozzle is shown by an enlarged section view taken along a line of FIG. 1 in FIG. 3, each of laminate films 7, 8 fused to each other at front and rear sides has a three-layer structure comprising a base film layer 9 disposed so as to a longitudinal direction (MD) substantially in a widthwise direction of the each laminate film and sealant layers 10, 11 laminated at both surfaces of the base film layer 9, wherein the sealant layers 10 opposing to each other at the inner surface side are fused to each other at a surrounding portion other than the base end under the required seal form over a given width, e.g. a width of 0.5-3 mm, preferably a width of 1.0-2.0 mm through heat sealing, whereby the pouring nozzle can be produced simply and always surely. Such a pouring nozzle 1 can be always properly and surely, simply joined to the package bag main body 2 by fusing the sealant layer 11 located at the outer surface side to the inner surface of the package bag main body 2 at the base end portion through heat sealing because it has a flat form.

In the pouring nozzle 1, as shown by a plan view in FIG. 1, it is preferable that the V-shaped fold portion 3 as an opening place is located at a downward tilted portion displaced at a somewhat top end side from such a position that the nozzle level becomes highest. Thus, when a packing material is poured by opening the nozzle 1 and then the pouring is stopped by returning the package bag to a standup posture, the liquid cutting property can be improved under an action of the slant fused portion in the lower fused part of the nozzle 1 to advantageously prevent the dropping of the packing material along the lower surface of the nozzle 1.

Figure 4:
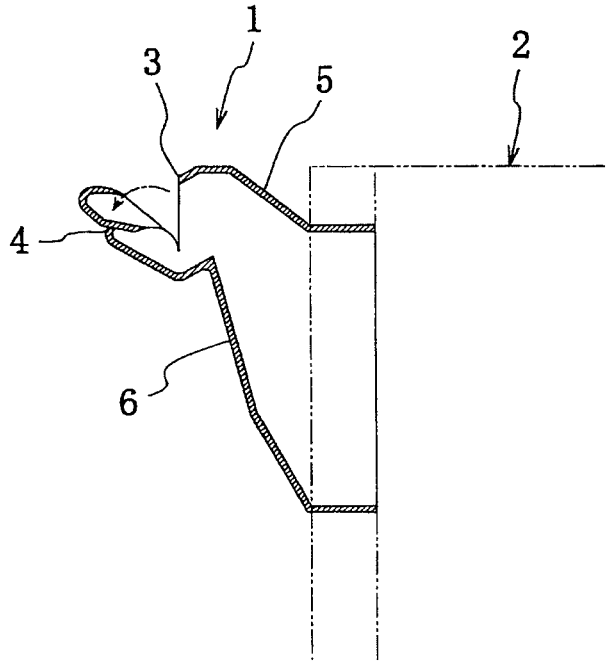
FIG. 4*a* is a schematic view showing a first tear opening example of a pouring nozzle.
FIG. 4*b* is a schematic view showing a second tear opening example of a pouring nozzle.
Figure 4:
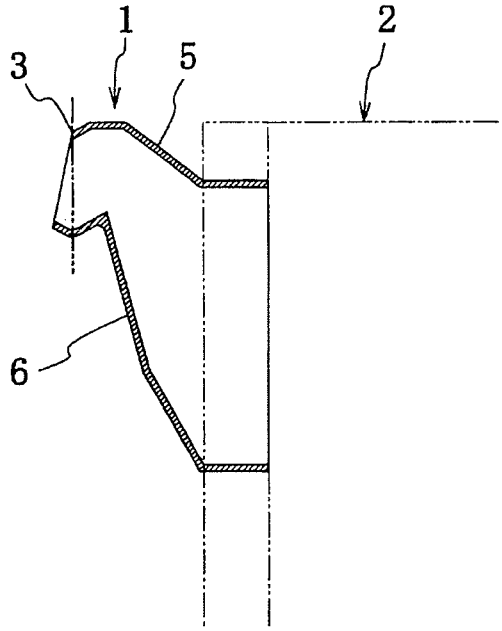

As to the liquid cutting property, the tear top pouring port of the pouring nozzle 1 is preferable to be a socket-like top end pouring port somewhat protruding a lower end within an angle range up to 15° ahead as shown in FIG. 4(*b*) as compared with a port extending in a vertical direction as shown in FIG. 4(*a*). This can be easily realized by matching the extending direction of the uniaxially oriented base film layer or longitudinal direction (MD) of the above "Emblet PC" or the like with the required extending direction of the tear top end opening port.

Figure 5:
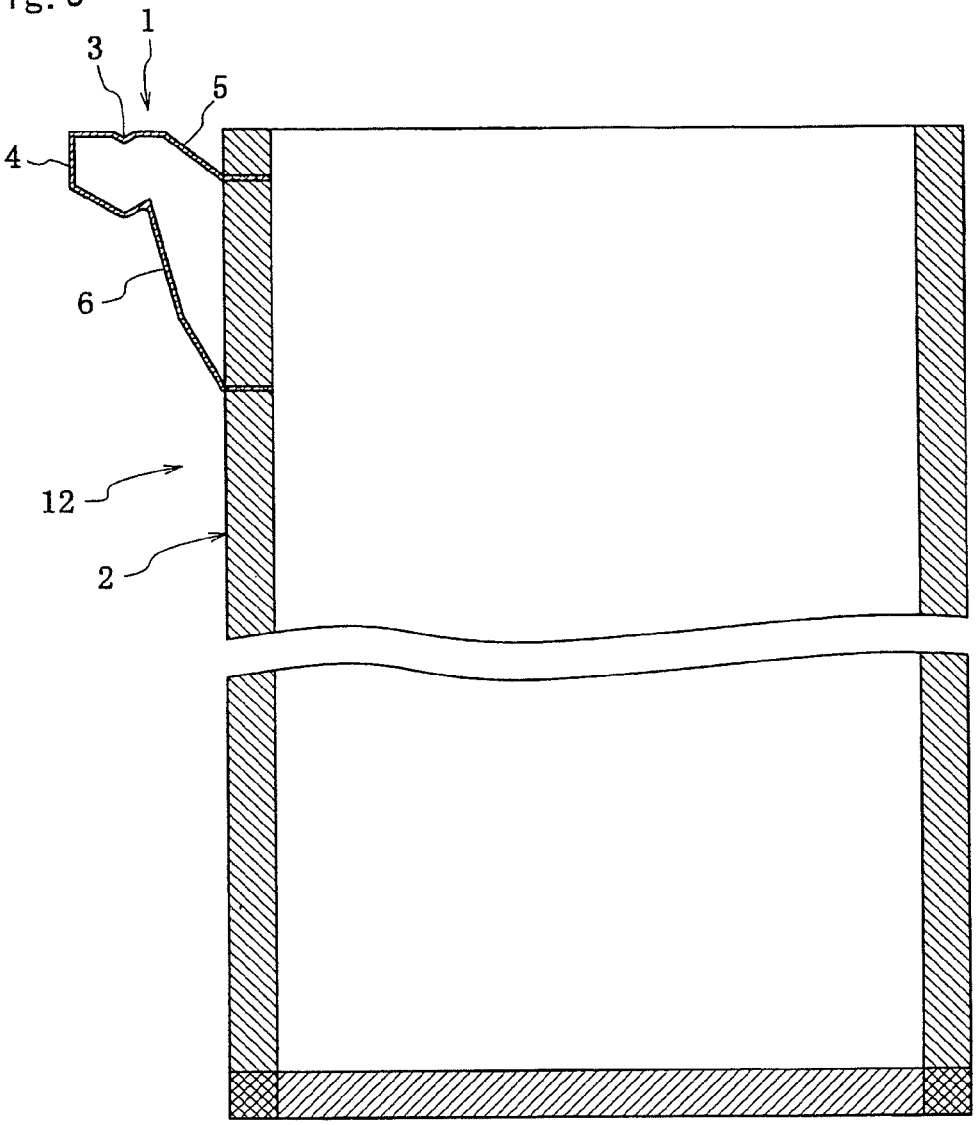
FIG. 5 is a plan view showing an embodiment of the package bag according to the invention.

As shown in FIG. 5, the liquid pouring nozzle having the above construction is rendered into a part of a package bag 12 by fusion-joining the sealant layer 11 located on the outer surface of the base end portion of the nozzle 1 to the inner surface of the package bag main body 2 at the fused portion of the sealant layers in the side portion of the package bag main body 2 at the same time of filling the packing material into the soft package bag main body or prior to the filling of the packing material through heat sealing, and protrudes sideward from the upper end portion of the package bag main body 2. In this case, the package bag main body itself and the fused portion between the package bag main body 2 and the pouring nozzle are shown by oblique lines in the figure.

Moreover, when the outer surface of the base end portion of the nozzle 1 is fusion-joined to the package bag main body 2, it is effective that the melting points of the sealant layers 10, 11 are made different as previously mentioned in order to prevent the sealant layers 10 at the inner surface of the nozzle from fusing to each other.

The sealant layer forming the inner surface of the soft package bag main body 2 is preferable to be constituted with the same kind of the resin material as in the sealant layer of the outer surface of the nozzle in view of the enhancement of the fusion strength. Also, the base film layer of the package bag main body, which may be provided with the deposited layer and/or a metal foil layer such as aluminum, may be constituted with the same as in the nozzle 1 or may be selected from various materials having the required properties.

Moreover, if the required properties in the package bag can not be ensured only by the base film layer, it is possible to interpose a middle layer between the sealant layer and the base film layer.

Figure 6:
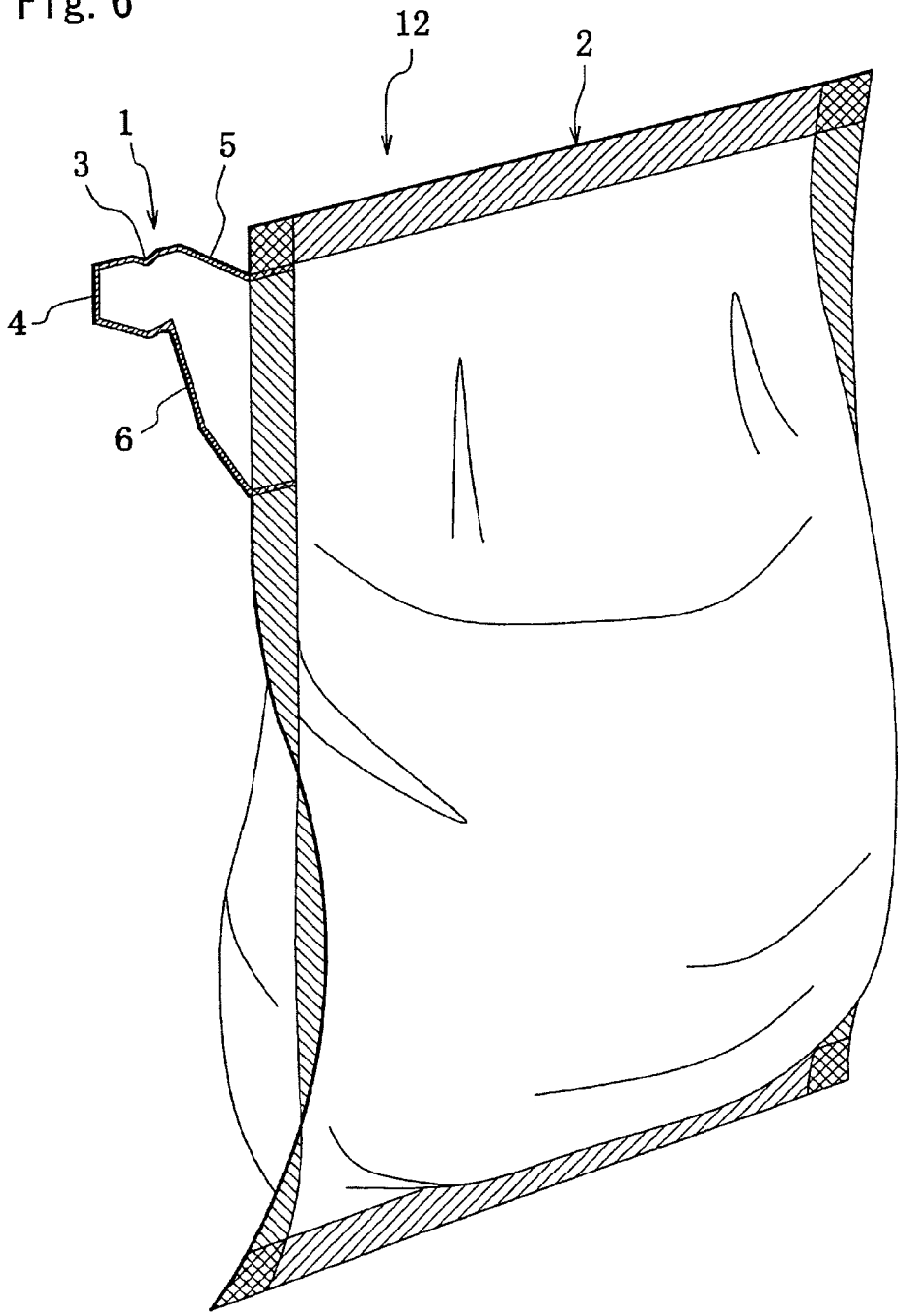
FIG. 6 is a perspective view showing a state of filling a packing material into a package bag.

Such a package bag 12 takes an expansion form as shown in FIG. 6 when a liquid packing material is filled thereinto, preferably under an evacuation. Since the soft package bag itself usually has not a self-standing property or shape formability, it is preferable that the package bag is housed in a box body made of a paper or the like under fixation or adhesion at plural places to provide the self-standing property and shape formability in the transportation, storage, display, use and the like of the packing material.

On the other hand, when the required amount of the packing material filled is poured, a top end portion of the pouring nozzle 1 is removed by tearing from the V-shaped fold portion 3 inn the upper fused portion 5 of the nozzle 1 with, for example, fingers to open the package bag 2, and then the package bag 12 is tilted together with the box body housing and holding it.

Figure 7:
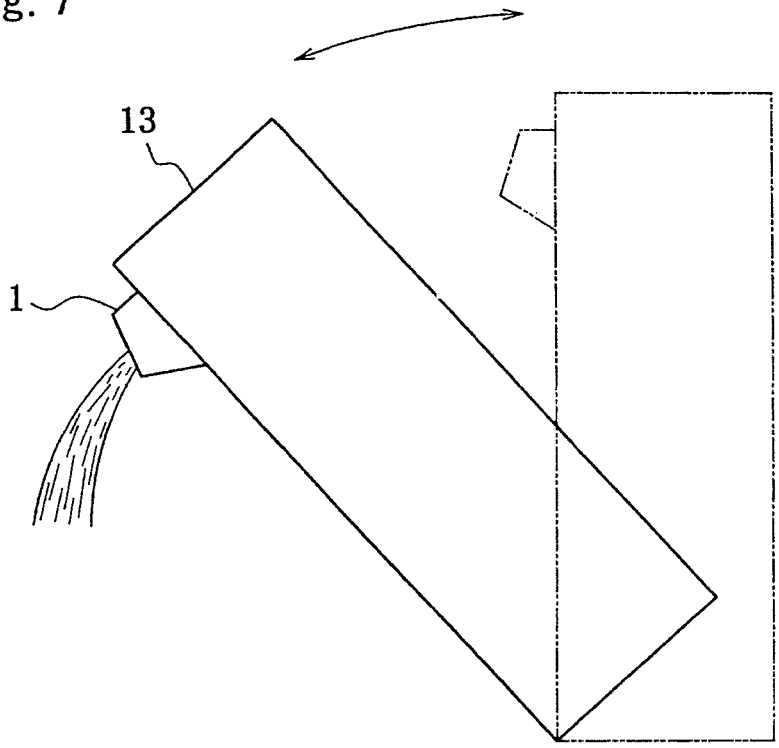
FIG. 7 is schematic view showing a pouring example of a packing material from a package bag housed in a box body.

FIG. 7 is a view showing this tilting state, wherein the top pouring port of the nozzle 1 of the package bag 12 in the box body 13 protruding from the box body 13 is released by the required amount at front and rear sides through the water head pressure of the packing material in the bag under such a tilting posture, whereby the pouring is carried out, if necessary.

Moreover, such a pouring is carried out by making large the tilting angle of the box body 13 in accordance with the decrease of the packing material in the bag.

In this case, the soft package bag 12 is subjected to a shrink deformation or collapse deformation in accordance with the volume of the pouring amount in the pouring of the packing material, so that the penetration of air into the package bag accompanied with the pouring is sufficiently prevented and hence the packing material in the bag is effectively protected from air.

After the required amount of the packing material is poured, the box body 13 is returned to a standup posture as shown by a phantom line in the figure to stop the pouring and bring about the automatic closing of the top end pouring port of the nozzle 1.

The closing seal of the pouring nozzle 1 is carried out by releasing the pouring nozzle 1 from the water head pressure to return the front and rear laminate films 7, 8 to the original form in the production of the pouring nozzle 1 and by rendering the front and rear films 7, 8 into an atmosphere under a reduced pressure in the flowing down of the packing material inside the pouring nozzle 1 into the package bag main body 2 to thereby negatively adsorb the inner surfaces of these soft films to each other over at least a whole of the nozzle width through a capillary phenomenon of the packing material and under the presence of the packing material adhered to the inner surfaces. Such a closing seal is surely maintained due to the fact that the package bag main body 2 collapse-deformed or the like renders the inside of the package bag 12 into a reduced pressure based on the elastic returning force.

Therefore, the packing material in the bag can be continually protected from air based on the stop of the pouring and the closing seal of the nozzle 1 and the subsequent continual maintenance of the closing seal. This is also true when the solid matter or the like is sandwiched in the nozzle.

When the pouring nozzle 1 having a simple structure and being cheap is fusion-joined to the package bag main body 2 through heat sealing or the like, the sure joining of them can be always realized simply. Further, the penetration of air into the package bag can be sufficiently prevented without special operation to the pouring nozzle 1 in the pouring operation of the packing material from the inside of the package bag 12.

Figure 8:
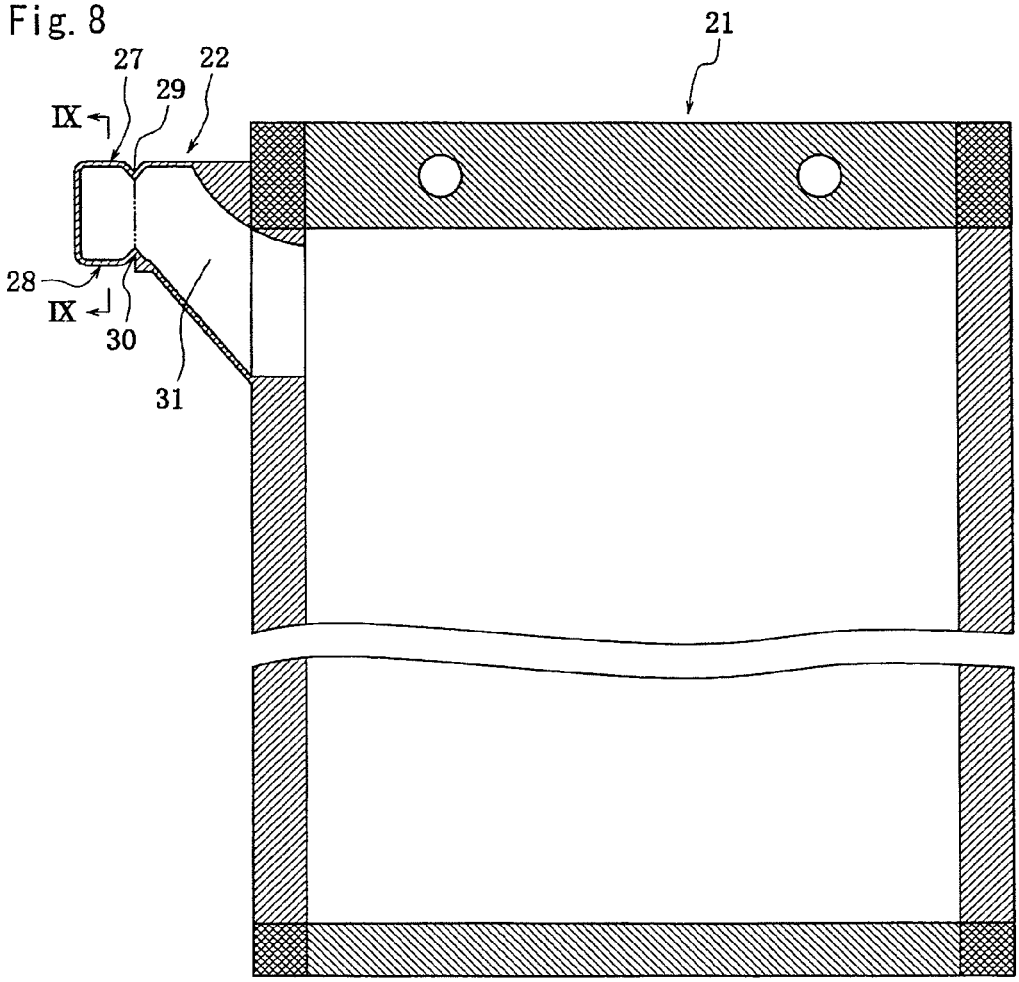
FIG. 8 is a plan view showing another embodiment of the liquid pouring nozzle.

FIG. 8 is a plan view of a main part showing an embodiment of another liquid pouring nozzle according to the invention together with a soft package bag main body.

Figure 9:
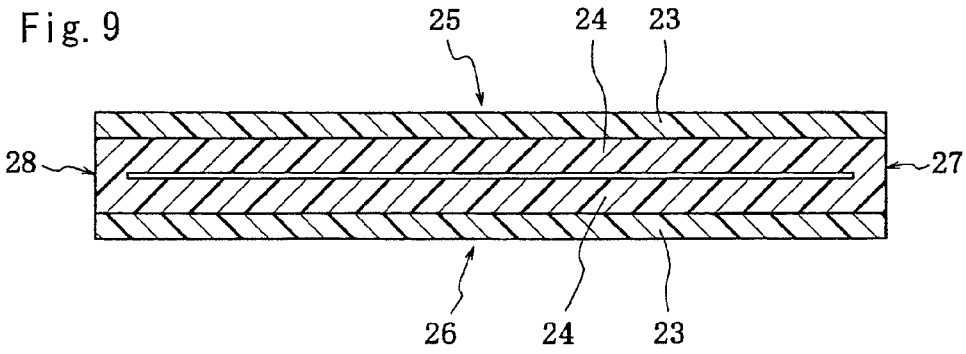
FIG. 9 is an enlarged section view taken along a line IX-IX of FIG. 8.

At the same time of forming a package bag main body 21 or before or after the formation, as seen from FIG. 9 showing a section taken along a IX-IX line of FIG. 8, a liquid pouring nozzle 22 integrally constituted therewith is formed by fusion-joining, for example, two laminate films 25, 26, each of which being formed by laminating a sealant layer 24 onto a uniaxially or biaxially oriented base film layer 23 through extrusion lamination or dry lamination, to each other at a posture of opposing the sealant layers to each other at a portion protruding from the package bag main body 21 or a surrounding portion of the protruded portion toward a side of an upper end portion in the figure through heat sealing, in which V-shaped fold portions 29, 30 are disposed on respective fused portions 27, 28 with respect to the widthwise direction of the laminate films 25, 26 at up and down positions.

In this case, it is preferable that the base film layer is a uniaxially or biaxially oriented PET layer or NY layer having a thickness of 8-30 μm, which may be provided with a deposited layer and/or a metal foil layer such as aluminum, and the sealant layer 24 is a non-oriented PE layer or PP layer having a thickness of 10-60 μm as previously mentioned.

In this pouring nozzle 22, the orienting direction of the uniaxially oriented base film layer or the longitudinal direction (MD) of the biaxially oriented base film layer is preferable to be substantially a widthwise direction corresponding to up-down directions of the laminate films 25, 26 shown in FIG. 8. Also, it is preferable that the fused portions 27, 28 of the laminate films 25, 26 opposing to each other in the widthwise direction and hence a nozzle flow path 31 defined thereby are extended downward at a side of the base end portion rather than the position of forming the V-shaped fold portions 29, 30 and that the interval between the fused portions 27, 28 is gradually decreased toward the V-shaped fold portions 29, 30 from the base end portion to the position of forming the V-shaped fold portions 29, 30.

In any case of the liquid pouring nozzle 22 and the aforementioned liquid pouring nozzle 1, it is preferable that the steam permeability of the uniaxially or biaxially oriented base film layer according to JIS K7129 is not more than 10 g/($m^2$□24 h) under conditions that a temperature is 40° C. and a humidity is 90% in view that the wet state of the pouring nozzles 1, 22 with the packing material and hence the closed seal state with the packing material is held over a long time of period.

That is, if the steam permeability exceeds 10 g/($m^2$□24 h), the water content of the packing material disappears in 8 days when the thickness of the packing material contributing the closing seal of the pouring nozzle 1, 22 is 10 μm per unit area of the respective films contributing to the definition of the nozzle path 31, and hence the one-way function of the pouring nozzle is damaged and there is a fear that the one-way period becomes too short in the packing material of a low pouring frequency.

On the other hand, it is preferable that the bending strength of the laminate film 7, 8, 25, 26 as a material constituting the respective pouring nozzle 1, 22 per a width of 15 mm is within a range of 40-300 mN.

Figure 10:
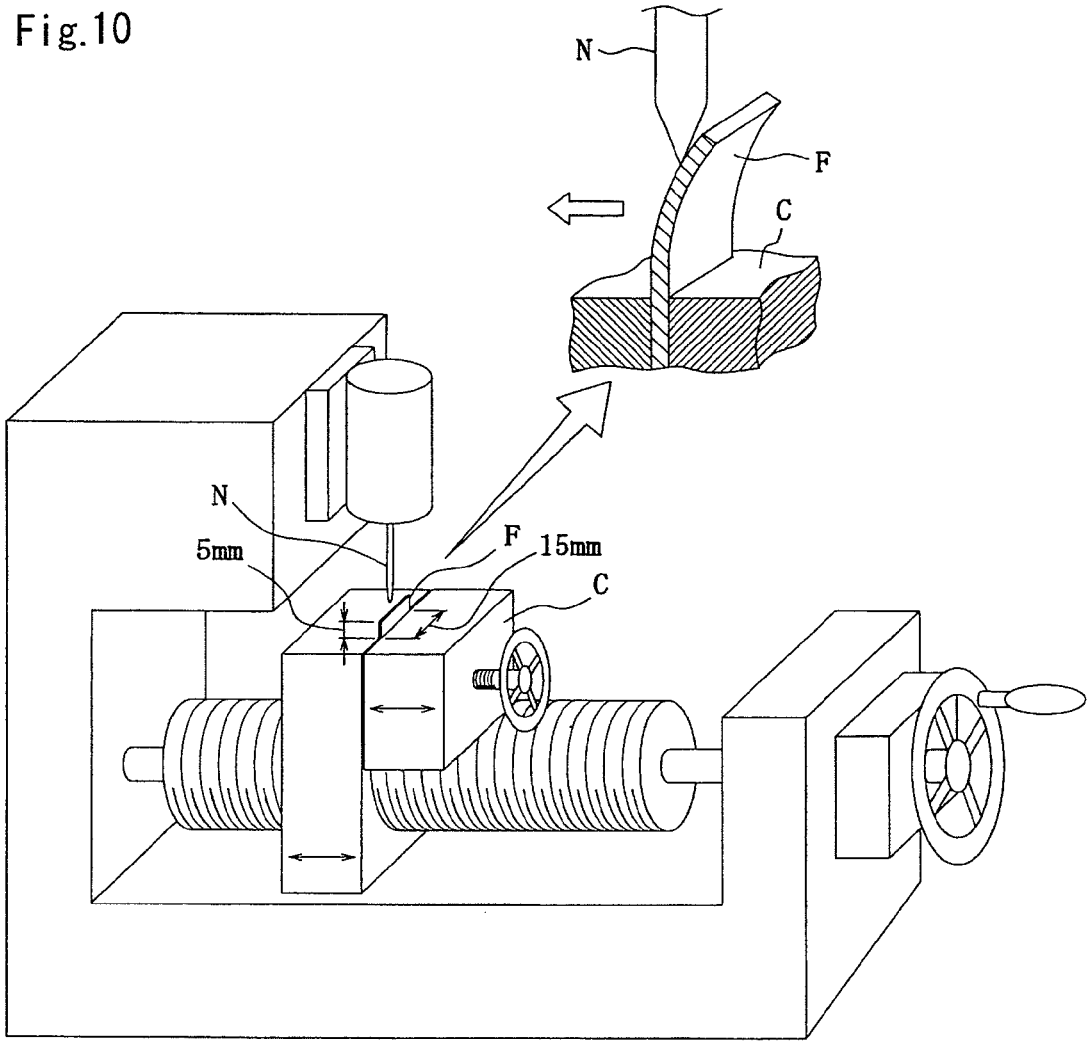
FIG. 10 is a schematically perspective view showing an apparatus for measuring a nerve.

As shown by a schematically perspective view in FIG. 10, the bending strength is a value measured when a laminate film F having a width of 15 mm is grasped with a clamper C so as to render a projection length of the laminate film F from the clamper C into 5 mm and the laminate film F is reciprocally displaced together with the clamper C to interface the top end portion of the laminate film F with a needle sensor N protruded from above over a protruding length of 2 mm and passed below the needle sensor N under a bending deformation of the laminate film F as shown by an enlarged section perspective view in the figure to measure a magnitude of input to the needle sensor N. The bending strength of the known biaxially oriented PET layer or nerve thereof measured by this method is shown in Table 1.

TABLE 1

| Film | Nerve (mN) |
|---|---|
| $PET^{12u}$ | 35 |
| $PET^{16u}$ | 69 |
| $PET^{25u}$ | 183 |
| $PET^{50u}$ | 1022 |

Also, the nerve of the laminate film suitable for use in the production of the liquid pouring nozzle 22 shown in FIG. 8, which is obtained by using a biaxially oriented PET layer or NY layer provided with a silica deposited layer as a base film layer and laminating polyethylene or polypropylene such as commercially available loading city polyethylene, linear loading city polyethylene or the like as a sealant layer on the base film layer through extrusion lamination or dry lamination, is shown in Table 2.

TABLE 2

| Laminate film | Nerve (mN) | Remarks |
|---|---|---|
| Silica deposited $PET^{12u}/XA\text{-}S^{30u}$ | 84 | corresponding to nerve of PET of 17.5 μm in thickness |
| Silica deposited $PET^{12u}/XA\text{-}S^{40u}$ | 95 | corresponding to nerve of EPT of 19.5 μm in thickness |
| Silica deposited $PET^{12u}/XA\text{-}S^{50u}$ | 181 | corresponding to nerve of EPT of 25.0 μm in thickness |
| Silica deposited $NY^{15u}/XA\text{-}S^{40u}$ | 126 | corresponding to nerve of EPT of 122.0 μm in thickness |

Moreover, the reason why the lower limit of the nerve is 40 mN is due to the fact that the pouring direction is precisely facilitated in the pouring of the packing material from the package bag as previously mentioned and also the lacking of the strength in the package bag main body integrally united with the pouring nozzle 22 is prevented, while the reason why the upper limit is 300 mN is due to the fact that the closing seal of the pouring nozzle in the stop of the pouring of the packing material is surely guaranteed.

In the liquid pouring nozzle 1, 22, it is preferable that the length of pouring port edge of the nozzle after the tear opening or the like is within a range of 5-40 mm in view that the sufficient pouring amount of the packing material is ensured and properly poured at an expected position without fearing the penetration of air into the package bag.

In the aforementioned liquid pouring nozzle 1, 22, it is preferable that the film thickness of the packing material included in the nozzle 1, 22 is within a range of 1-50 μm in relation to the viscosity of the packing material, water content, wettability of the nozzle itself and others in the closing seal of the nozzle accompanied with the stop of the pouring of the packing material.

Although the pouring nozzle 22 is constituted so as to protrude from the upper end portion at the side portion of the soft package bag main body 21 in FIG. 8, the protruding position and form of the pouring nozzle 22 can be properly selected, if necessary. It may be disposed from the top portion of the package bag main body 21.

In the package bag having the above construction, when a silicone oil or other volatile substance is applied to the outer surface of the portion forming at least the pouring port of the pouring nozzle 1, 22 or an outer surface of the V-shaped fold portion 3, 29, 30 located toward the nozzle base end side than the position of the top pouring port formed by tearing of the nozzle top end portion irrespectively of the liquid pouring nozzle being integrally constituted with or separately constituted from the package bag main body, the liquid cutting property in the stop of the pouring of the packing material can be more improved.

Even in the package bag formed by integrally constituting the liquid pouring nozzle 22 with the package bag main body 21 as shown in FIG. 8, when the packing material filled as shown in FIG. 6 is poured and stopped, the penetration of air into the package bag main body 21 can be effectively prevented under the same automatic one-way function of the liquid pouring nozzle 22 as in the aforementioned pouring nozzle 1.

Of course, the aforementioned liquid pouring nozzles can develop the excellent one-way function to air when they are applied to the soft package bag main body used for packing a liquid flavor such as soy sauce, sauce, dressing or the like, various soups, milk beverages, fruit juices, oils, an alcohol beverage such as sake, win or the like, detergents inclusive of powdery matters, liquid medicines and so on.

An embodiment of the box for package bag according to the invention will be described below.

Figure 11:
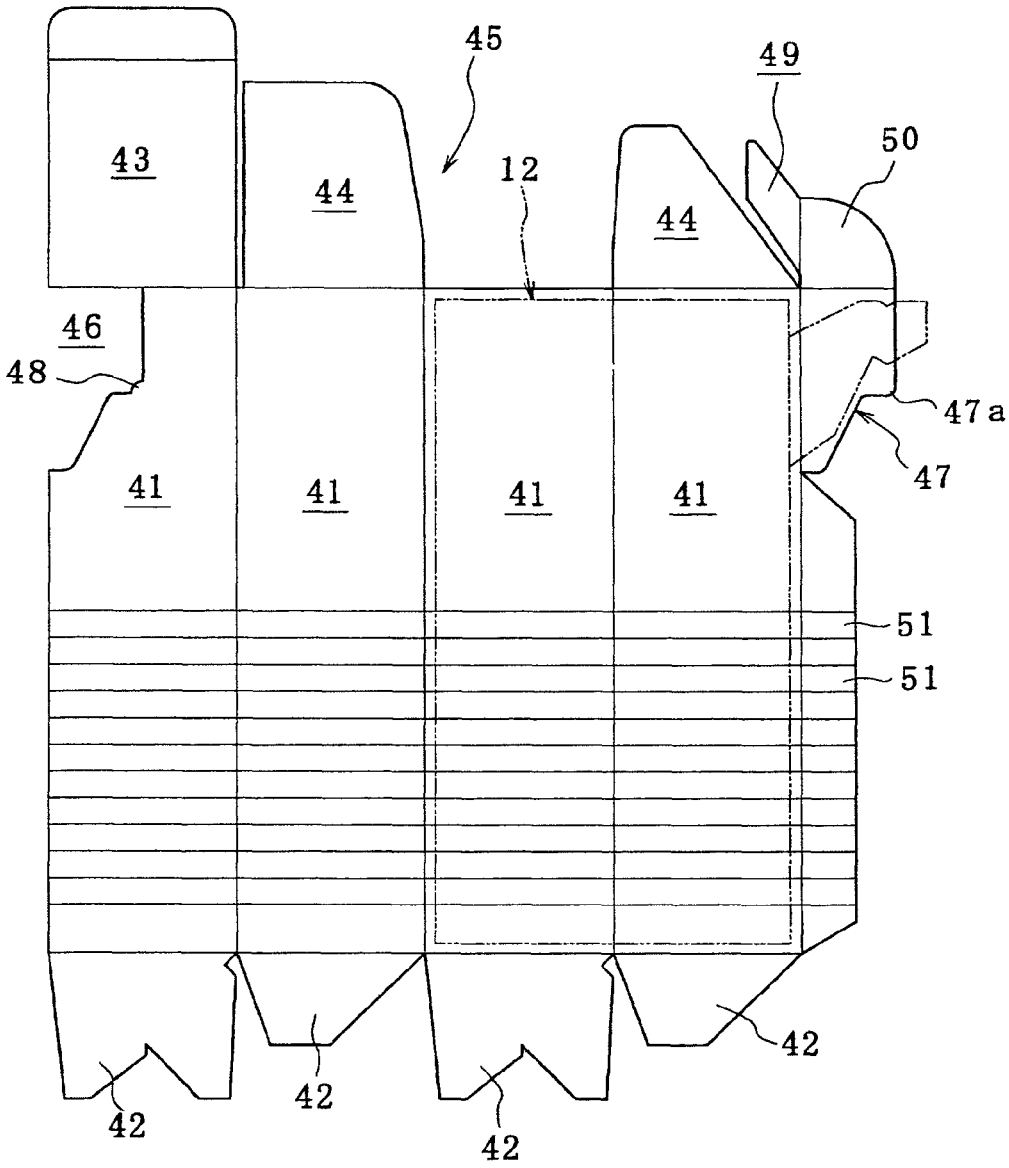
FIG. 11 is a developed view showing an embodiment of a box for a package bag.
Figure 12:
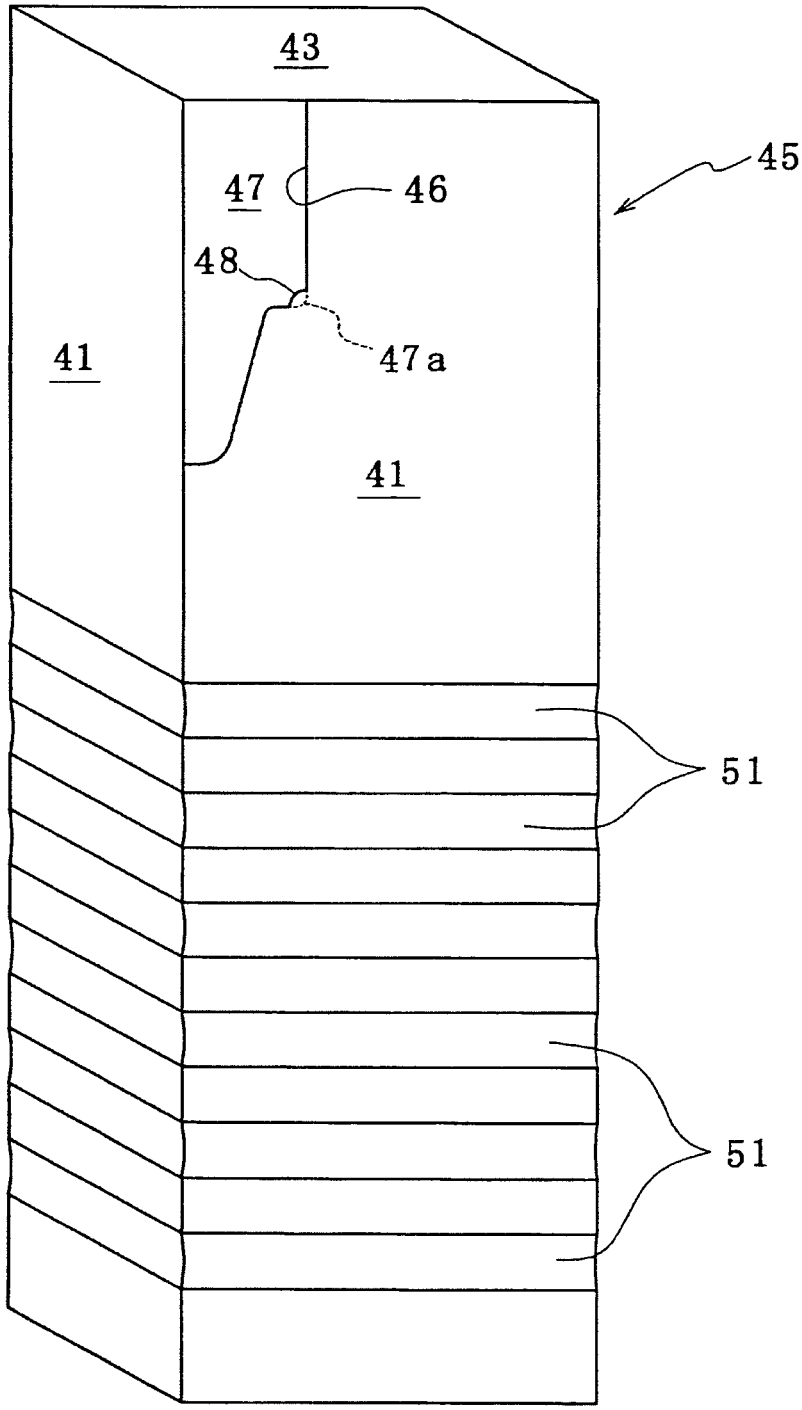
FIG. 12 is a perspective view showing an assembled state of a box for a package bag.

FIG. 11 is a developed view of a box for a package bag, and FIG. 12 is a perspective view showing an assembled state thereof.

The box for the package bag to be assembled into a quadratic prism as a whole comprises four side walls 41, respective bottom wall constituting members 42, a cap cover 43 projected upward from one side wall 41 as shown in FIG. 11, and top fold portions 44 projected upward from the two side walls 41, in which a phantom line in FIG. 11 is shows a posture of the soft package bag 12 as shown in FIGS. 5 and 6 housing in the box for the package bag and not filled with the packing material.

In the box 45 for the package bag made of a paper, preferably a water-proof paper, as shown in FIG. 12, the upper part of the one side wall 41 is provided with a door member 47 swingably displacing at a corner part of such a side wall 41 as a fulcrum on a horizontal plane to just fit into an opening port 46 formed on the upper part of the side wall 41, while a protrusion 48 engaging with an outer surface of the door member 47 or an outer surface of a corner part 47*a* as a projecting corner of the door member 47 in the figure is disposed on the side wall 41 formed with the opening port 46 (hereinafter referred to as an opening side wall).

The protrusion 48 is advantageous to be disposed in correspondence with the corner part as a projecting corner or an entering corner in the door member 47 in view of decreasing the projecting amount, but it is possible to dispose in correspondence with the linear extending portion of the door member 47.

Also, a stopper 49 engaging with the inner surface of the opening side wall 41 to restrain the excessive releasing of the door member 47 is arranged on the door member 47, preferably through a connecting member 50 connected to an upper end of the door member 47.

Figure 13:
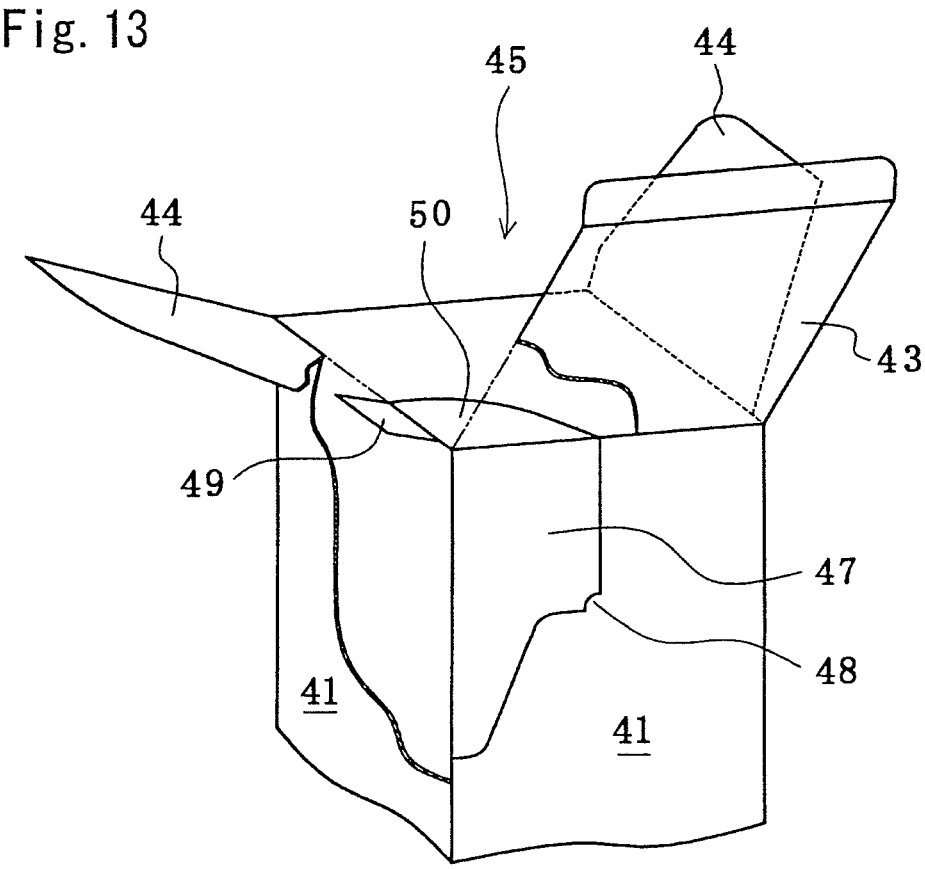
FIG. 13 is a partly broken enlarged view showing an state of housing a stopper and a connecting member under the closing of a door member.

FIG. 13 is a partly broken enlarged perspective view showing a closed posture of the door member 47. At such a closed posture, the connecting member 50 is located in the horizontal plane, while the stopper 49 takes an extended from coming into contact with the inner face of the side wall 41 adjacent to the opening side wall 41 and separated its top end from the door member 47 as compared with a base end side thereof at a state of directing vertically and downward therealong.

Figure 14:
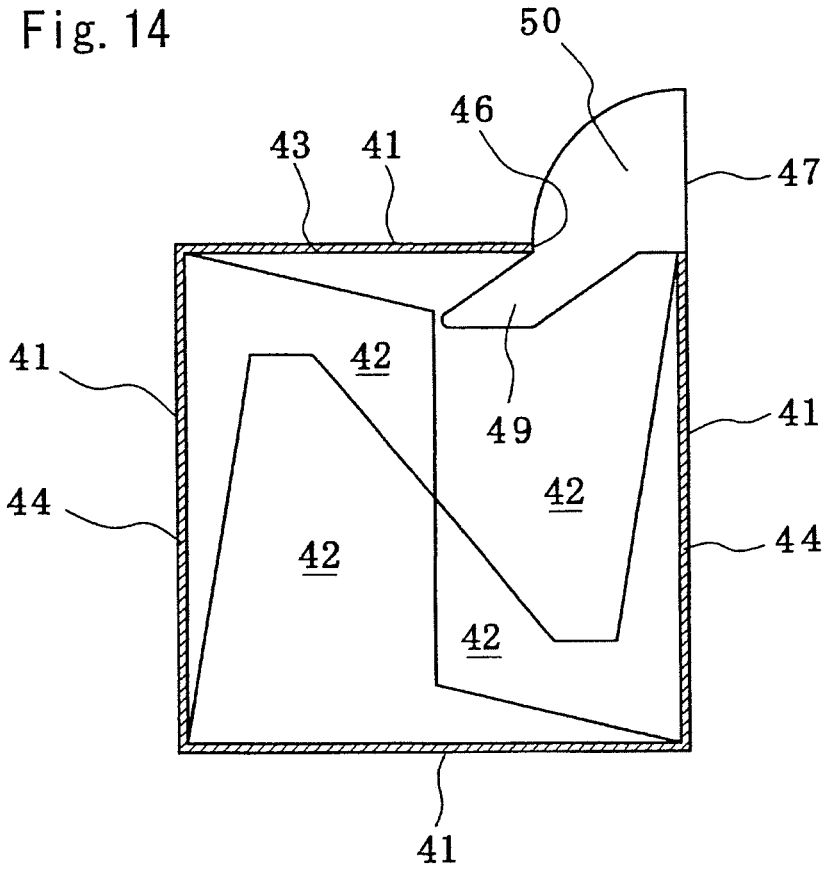
FIG. 14 is a partly broken plan view showing a function state of a stopper.

On the other hand, the stopper 49 engages with the inner surface of the opening side wall 41 at a state of opening the door member 47 at a given angle, e.g. 90° as the cap cover 43 and the top fold portion 44 are shown by a plan view partly broken in FIG. 14, which acts to restrain the excess opening of the door member 47.

When the connecting member 50 is substantially a fan member as shown in the figure and its surrounding edge serves as an open-close guide slidably contacting with an interface between the opening side wall 41 and the cap cover 43 continued thereto, it can sufficiently guarantee the smooth and sure open-close operation of the door member 47.

The open-close operation of the door member 47 in the box 45 for the package bag can be carried out by push-deforming the neighborhood portion of the engaging protrusion 48 in the opening side wall 41 to enter the engaging protrusion 48 into the inside of the door member 47 under elastic deformation of at least one of the protrusion 48 and the projecting corner part 47*a* of the door member 47 and then swinging the door member 47 about the fulcrum to displace the stopper 49 up to the opening limit position contacting with the inner surface of the opening side wall 41 as shown in FIG. 14.

The closing of the opened door member 47 can be carried out by push-deforming the door member 47 toward the side wall opening port 46 under a guide of the connecting member 50 to render the stopper 49 into an extending posture at the vertical face as shown in FIG. 13 owing to its bending form and pushing the door member 47 into the inside of the engaging protrusion 48. Thus, the door member 47 is surely held at the closed posture under the engagement with the protrusion 48.

In such a box 45 for the package bag, in order to develop an excellent shape formability sufficiently durable to the collapse deformation of the soft package bag housed in the box and filled with the packing material even if the thickness of the paper material used is made thin, it is preferable to at least arrange a plurality of concaves 51 extending in a horizontal direction on each side wall 41 at a lower half portion of the box body as shown in FIGS. 11 and 12.

The box 45 for the package bag is mainly acted so as to give the shape formability to the soft package bag, whereby the lamination of the resin material to the box body is made useless, and hence the recycling of the box 45 can be made easy and also it is possible to use a waste paper in the box itself to thereby attain the reduction of the cost while advantageously contributing to resource saving.

Further, by disengaging the engaging protrusion 48 of the door member 47 can be realized the sure closing of the door member 47 and the simple releasing thereof inclusive of the opening as is expected.

In the packaging structure according to the invention, as the soft package bag contributing to the filling of the packing material and housing into the box for package bag can be used the same as previously mentioned in relation to FIGS. 5, 6, 8 and the like.

In the embodiment of FIG. 5, the package bag 12 takes an expansion form as shown in FIG. 6 when the liquid packing material is filled thereinto, preferably under an evacuation. However, the soft package bag itself usually has not the self-standup property and shape formability, so that the package bag is housed in the box 45 for the package bag under the fixation or adhesion at plural places to provide the self-standup property and shape formability in the transportation, storage, display and use of the packing material.

On the other hand, when the required amount of the packing material is poured, the package bag 12 is opened by removing the top end portion of the liquid pouring nozzle 1 from the V-shaped fold portion 3 of the upper side fused portion 5 of the nozzle 1 and then the package bag 12 is tilted together with the box body housing and holding it.

The attachment of the package bag 12 filled with the packing material to the inner surface side of the box 45 can be carried out, for example, by restraining the heat seal part of the upper end portion of the package bag main body 2 to the respective side walls 41 of the box 45 through a fixation with a through pin, a stapler or the like or through adhesion with a hot melt or other adhesive or tackifier to prevent the fall-down of the package bag 12 and locally, directly or indirectly fixing or adhering the liquid pouring nozzle 1 to the inner surface side of the door member 47 to conduct the integral opening-closing of the pouring nozzle 1 and the door member 47 and positioning a part of the pouring nozzle 1 in correspondence with the swing supporting point of the door member 47 as shown in FIG. 11.

Figure 15:
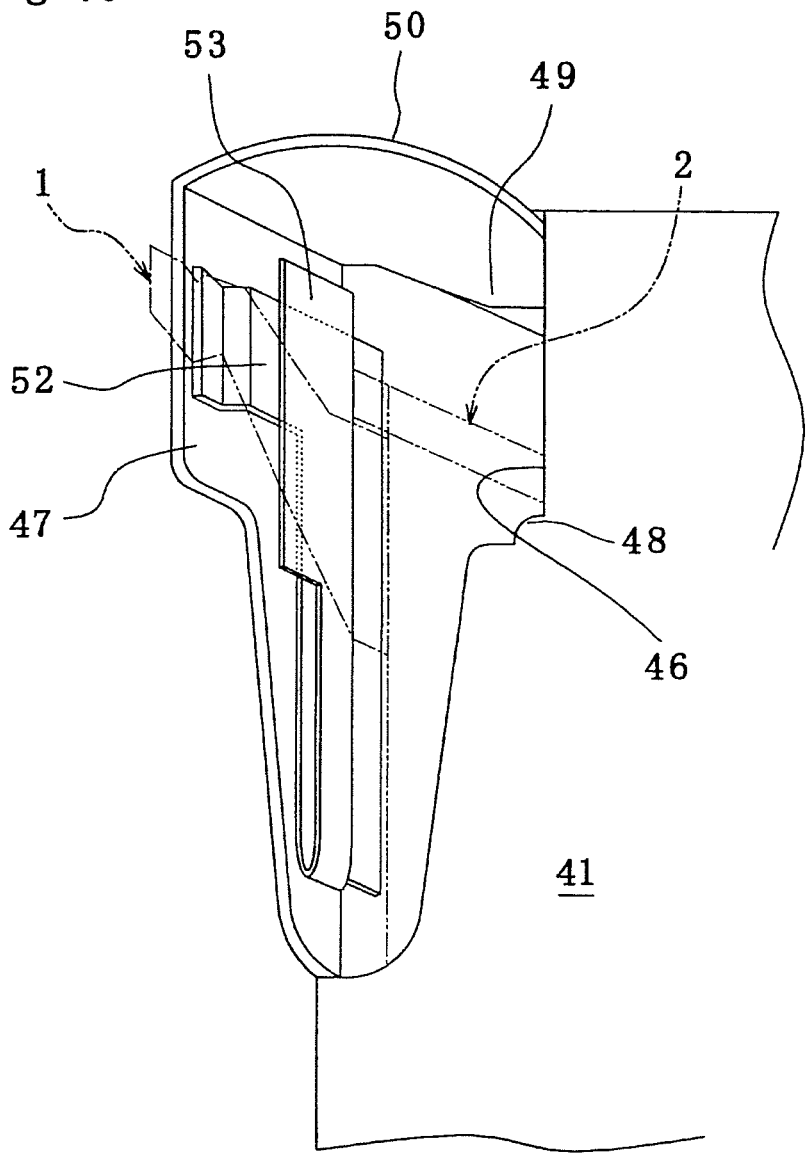
FIG. 15 is an enlarged perspective view of a spacer and the like viewing slantly from bottom.
Figure 16:
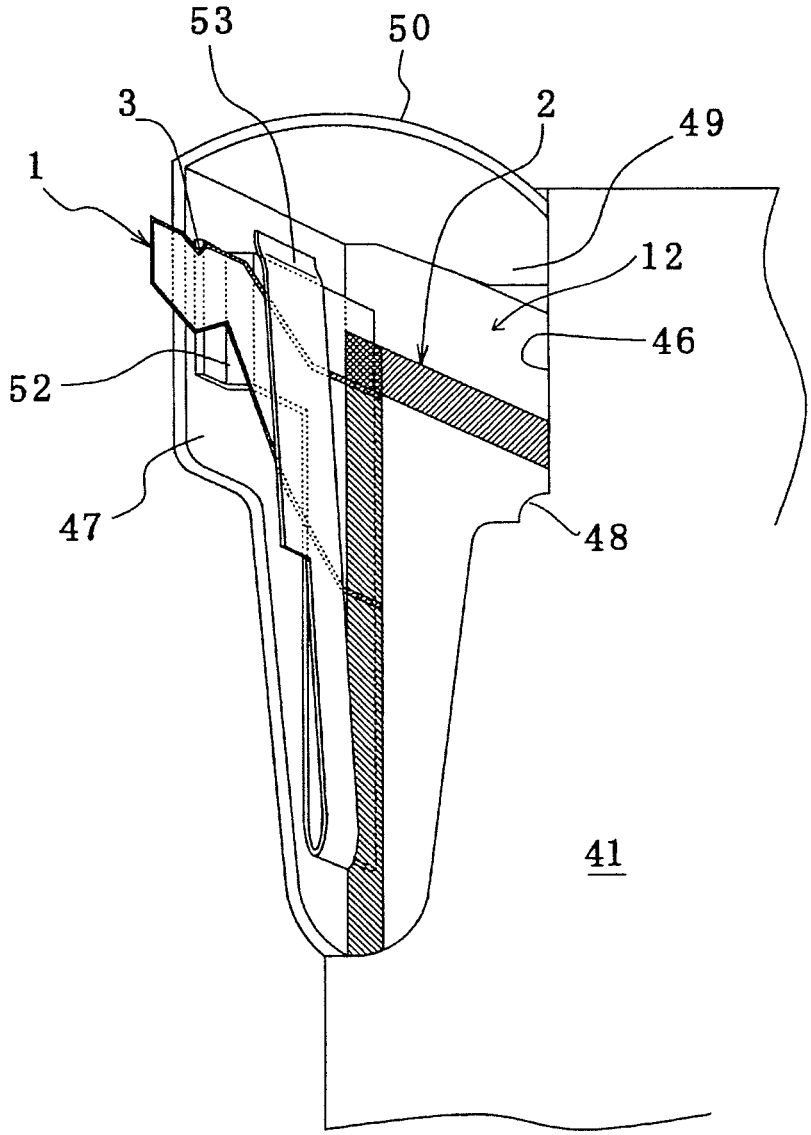
FIG. 16 is the same view as FIG. 15 showing a state of holding a pouring nozzle by a folded portion.

Such an attachment of the liquid pouring nozzle 1 may be carried out by arranging a spacer 52, which separates the top end portion of the pouring nozzle 1 from the inner surface of the door member 47, to the inner surface side of the door member 47 through adhesion or the like as shown in FIG. 15 viewing slantly from the bottom of the door member of the opening posture and fixing or adhering one surface of the nozzle 1 to a local bottom of the spacer 52 but also may be conducted by disposing a fold portion 53 as shown in the figure on the spacer 52 folding the fold portion 53 so as to moderately sandwich the pouring nozzle 1 as shown in FIG. 16 and adhering or tackifying the folded end of the fold portion 53 to the inner surface of the door member 47 to hold the liquid pouring nozzle 1.

This is also true when the package bag 21 shown in FIG. 8 is housed in the box 45 at a state of filling the packing material therein.

Figure 17:
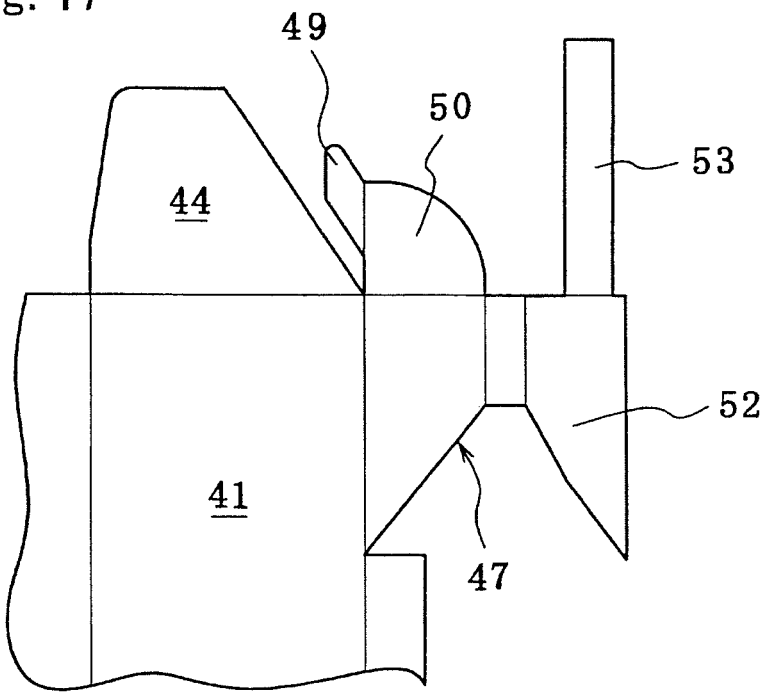
FIG. 17 is a developed view of a main part showing another forming example of a stopper.

FIG. 17 is a developed view of a main part showing a case that the spacer and fold portion having the above functions are integrally formed with the door member. The spacer 52 can develop the expected function by folding two fold portions of the door member 47 located at a right side of the figure in the mountain form and adhering the right end portion of the spacer 52 in the figure to the inner surface of the door member 47 or the like. The fold portion 53 is folded toward down side in the figure to hold the pouring nozzle 1 and the folded free end portion thereof can be adhered to the spacer 52 to develop the expected function.

When the packing material in the package bag is poured from the packing structure having the above construction, the door member 47 in the box 45 for the package bag is first released up to the limit position as mentioned above to render the liquid pouring nozzle 1 of the package bag 12 into an opening posture as shown in FIG. 16, at where the top end portion of the pouring nozzle 1 is removed by tearing the V-shaped fold portion 3 thereof with fingers to form a top opening port in the nozzle 1.

Figure 18:
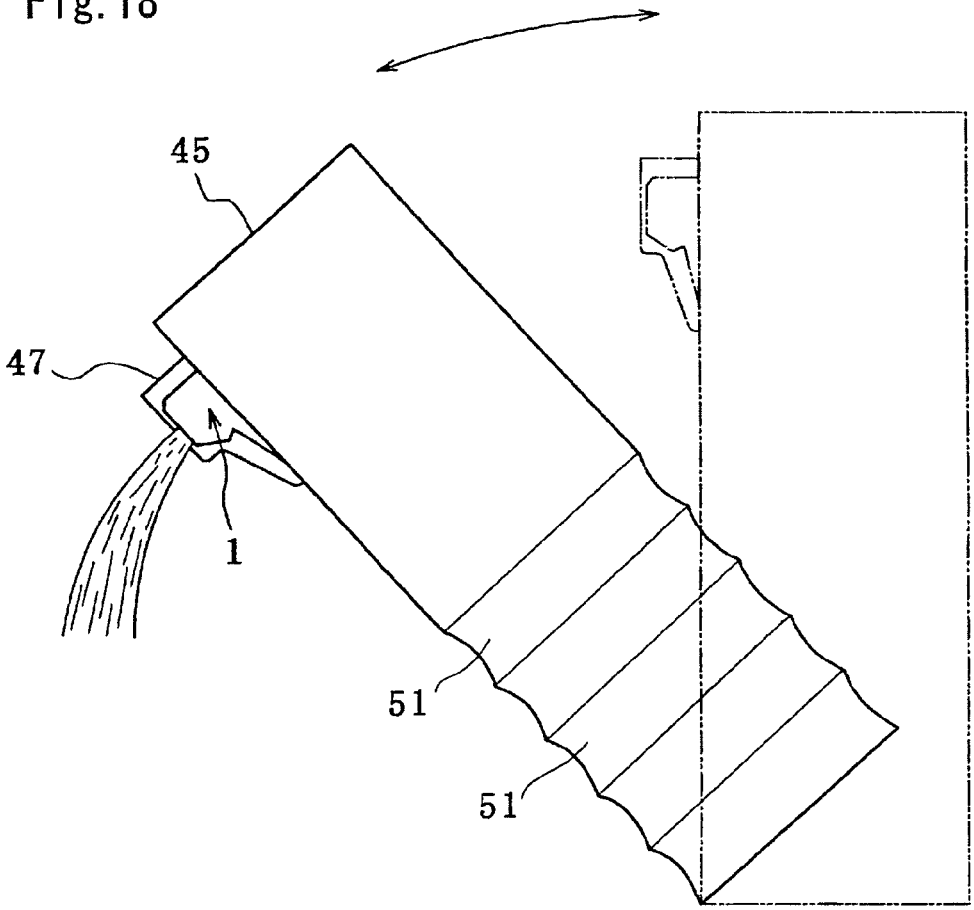
FIG. 18 is a side view showing an example of pouring a packing material.

After the package bag 12 is opened as mentioned above, the box 45 for the package bag is tilted as shown in FIG. 18 at a state of lifting up the box to pour the packing material in the bag. In this case, the pouring of the packing material can be conducted under the nozzle position specified by the door member 47 and under visual observation of the pouring nozzle 1 protruding from the side wall 41 of the box 45. Also, the level of the packing material in the package bag is usually located downward below the door member 47, so that the packing material can be always and surely flowed down to the position as is expected.

In such a pouring of the packing material, the top end opening port of the pouring nozzle 1 attached to the door member 47 and protruding from the opening side wall 41 is opened by the required amount to front and rear sides through the water head pressure of the packing material in the bag, and hence the required pouring is conducted smoothly. The flow amount through this pouring is surely conducted by making the tilting angle of the box 45 large in accordance with the decreasing amount of the packing material inside the bag.

Since the soft package bag 12 is shrink-deformed or collapse-deformed in accordance with the pouring volume in such a pouring of the packing material, the penetration of air into the package bag accompanied with the pouring is sufficiently prevented and the packing material in the bag is effectively protected from air.

After the required amount of the packing material is poured, the box 45 is returned to the standup posture shown by a phantom line in the figure to stop the pouring and hence bring about the automatic closing seal of the top end opening port of the nozzle 1.

As previously mentioned, the closing seal of the pouring nozzle 1 is carried out by releasing the pouring nozzle 1 from the water head pressure to return the laminate films at front and rear sides to the original form at the time of producing the pouring nozzle 1 and by exposing the front and rear films to an atmosphere under a reduced pressure in the flowing down of the packing material inside the pouring nozzle 1 into the package bag main body 2 to thereby negatively adsorb these soft films to each other over at least a whole of the nozzle width. Such a closing seal is surely maintained by rendering the inside of the package bag into a reduced pressure based on the elastic returning force inherent to the collapse-deformed package bag main body 2.

In this case, therefore, the packing material inside the bag can be continually protected from air from the time of pouring stop based on the closing seal of the nozzle 1 in the pouring stop and the continual maintenance of the closing seal.

In the embodiment of FIGS. 15, 16 and the like, the pouring of the packing material from the liquid pouring nozzle 1 is carried out through the top end opening port of the pouring nozzle 1 positioned apart from the inner surface of the door member 47 under the action of the spacer 52, so that the poured packing material does not adhere to the door member 47, and hence the packing material adhered does not fall down to the bottom of the box 45 in the standup returning of the box 45.

After the completion of the required pouring, the door member 47 is rendered into the closing posture as shown in FIG. 12 by engaging the outer surface thereof with the engaging protrusion 48 as previously mentioned to conduct the complete and sure closing of the door member 47. In addition, the liquid pouring nozzle 1 is folded to substantially 90° from the pouring position of the packing material at the position corresponding to the swing supporting point of the door member 47.

The folding of the liquid pouring nozzle 1 brings about the further adhesion between the front and rear films in the pouring nozzle 1, so that after the closing of the door member 47, the penetration of air into the package bag is more surely prevented, and also the leakage of the packing material can be prevented more sufficiently even in the accidental fall down of the box 45 for the package bag or the like.

Such a folding deformation of the pouring nozzle 21 is conducted more surely and always properly when the pouring nozzle 1 is held by the fold portions 53 integrally and swingably displacing with the door member 47 as shown in FIGS. 15-17.

INDUSTRIAL APPLICABILITY

The liquid pouring nozzle, box for package bag including the package bag and packaging structure according to the invention are used for packing a liquid flavor such as soy sauce, sauce or the like, various soups, milk beverages, fruit juices, oils, an alcohol beverage such as sake, win or the like, dressings and detergents inclusive of powdery matters, liquid medicines and so on, and particularly are applied to package vessels of all fields required for preventing the deterioration of quality in the content by developing the excellent one-way function to air after the opening.

The invention claimed is:

1. A package bag with a liquid pouring nozzle integrally constituted by protruding from a side portion or a top portion of a soft package main body, wherein the liquid pouring nozzle is formed by fusion-joining front and rear laminate films, each of which films comprising a uniaxially oriented or biaxially oriented base film layer having a steam permeability (HS K7129) of not more than 10 g/($m^2$/24 h) and a sealant layer laminated on a surface thereof, which films are the same film as the package bag main body, at a surrounding portion thereof at a posture of opposing the sealant layers to each other, and the laminate film has a bending strength per 15 mm width of 40-300 mN, wherein a volatile substance is applied onto an outer surface of a portion of the liquid pouring nozzle at least forming a pouring part.

* * * * *